US011187474B2

(12) United States Patent
Masters

(10) Patent No.: US 11,187,474 B2
(45) Date of Patent: Nov. 30, 2021

(54) COMPACT SHOTGUN, MULTIPURPOSE MOUNT, AND TRIGGER ASSEMBLY

(71) Applicant: William E. Masters, Greenville, SC (US)

(72) Inventor: William E. Masters, Greenville, SC (US)

( * ) Notice: Subject to any disclaimer, the term of this patent is extended or adjusted under 35 U.S.C. 154(b) by 0 days.

(21) Appl. No.: 16/243,238

(22) Filed: Jan. 9, 2019

(65) Prior Publication Data

US 2019/0212082 A1 Jul. 11, 2019

Related U.S. Application Data

(60) Provisional application No. 62/615,071, filed on Jan. 9, 2018.

(51) Int. Cl.

| | |
|---|---|
| ***F41A 3/66*** | (2006.01) |
| ***F41A 19/10*** | (2006.01) |
| ***F41A 21/48*** | (2006.01) |
| ***F41A 19/09*** | (2006.01) |
| ***F41A 3/24*** | (2006.01) |
| ***F41A 19/53*** | (2006.01) |
| *F41G 1/38* | (2006.01) |
| *F41C 7/00* | (2006.01) |
| *F41F 1/08* | (2006.01) |

(52) U.S. Cl.

CPC *F41A 3/66* (2013.01); *F41A 3/24* (2013.01); *F41A 19/09* (2013.01); *F41A 19/10* (2013.01); *F41A 19/53* (2013.01); *F41A 21/48* (2013.01); *F41C 7/00* (2013.01); *F41F 1/08* (2013.01); *F41G 1/38* (2013.01)

(58) Field of Classification Search

CPC .... F41A 3/24; F41A 3/66; F41A 19/09; F41A 19/10; F41A 19/35; F41A 19/38; F41A 19/40; F41A 19/48; F41A 19/484; F41A 19/485; F41A 19/51; F41A 19/53; F41A 21/48; F41C 7/00; F41F 1/08; F41G 1/38

See application file for complete search history.

(56) References Cited

U.S. PATENT DOCUMENTS

| | | | | |
|---|---|---|---|---|
| 3,442,173 A * | 5/1969 | Muller | F41A 19/46 | 89/127 |
| 3,507,067 A * | 4/1970 | Into | F41C 27/06 | 42/10 |
| 5,249,385 A * | 10/1993 | Vang | F41A 21/28 | 42/1.06 |
| 5,628,137 A * | 5/1997 | Cortese | F41C 27/06 | 42/105 |

(Continued)

OTHER PUBLICATIONS

United States of America Department of Defense, Military Standard entitled, Dimensioning of Accessory Mounting Rail for Small Arms Weapons, MIL-STD-1913 (AR); Feb. 3, 1995.

(Continued)

*Primary Examiner* — Bret Hayes

(74) *Attorney, Agent, or Firm* — JK Intellectual Property Law, PA

(57) ABSTRACT

A compact shotgun, a trigger assembly that could be used with such compact shotgun or other firearms, and an adapter and multipurpose mount that could be used with firearms or other devices are all disclosed. Each element has separate utility and combined utility in forming a combined under-mounted shotgun and long gun assembly.

22 Claims, 20 Drawing Sheets

(56) References Cited

U.S. PATENT DOCUMENTS

| | | | | |
|---|---|---|---|---|
| 6,250,194 | B1 * | 6/2001 | Brandl | F41A 19/18 42/71.01 |
| 6,418,655 | B1 * | 7/2002 | Kay | F41A 3/46 42/70.08 |
| 7,966,763 | B1 * | 6/2011 | Schneider | F41C 27/06 42/105 |
| 8,839,709 | B1 * | 9/2014 | Crye | F41A 3/66 89/157 |
| 9,341,429 | B1 * | 5/2016 | Reavis, III | F41A 35/02 |
| 2006/0026885 | A1 * | 2/2006 | Tony | F41A 19/10 42/105 |
| 2006/0048427 | A1 * | 3/2006 | Crandall | F41A 19/09 42/69.01 |
| 2011/0016765 | A1 * | 1/2011 | Griffin | F41A 21/48 42/105 |
| 2017/0328665 | A1 * | 11/2017 | Bailey | F41A 21/10 |

OTHER PUBLICATIONS

Department of the Army, United States, M26 Modular Accessory Shotgun System, TC 3-22.12, Nov. 2014.

* cited by examiner

COMPACT SHOTGUN, MULTIPURPOSE MOUNT, AND TRIGGER ASSEMBLY

CROSS-REFERENCE TO RELATED APPLICATIONS

The present application is a Non-Provisional Patent Application and claims priority to U.S. Provisional Patent Application Ser. No. 62/615,071, filed Jan. 9, 2018, which is incorporated by reference herein.

TECHNICAL FIELD

The present disclosure relates generally to a shotgun which may be a compact shotgun, to a trigger assembly that could be used with such compact shotgun or other firearms, and to an adapter and multipurpose mount that could be used with firearms or other devices. More particularly, some aspects of the disclosure relate to a compact shotgun that may be configured for mounting beneath the barrel of another long gun or used separately, and various components therefor

BACKGROUND

Shotguns have been introduced that can be mounted beneath the barrel of another long gun, such as a rifle. Such "underbarrel" or "undermount" shotguns are configured with firearm components such as a barrel, breech, fire control unit (i.e., trigger assembly), etc., as well as a connector such as a "Picatinny" rail (MIL-STD-1913) connection or other accessory mount structure for mounting the shotgun beneath the long gun. Such undermount shotguns may not have a conventional headstock, as the headstock of the rifle is used for support during firing of the long gun and the shotgun. The M26 Modular Accessory Shotgun System (from C-More Systems) and the "Masterkey" (from Knight Armament Company) are two examples of existing undermount shotguns.

While existing products have been successful, improved and alternative shotguns, fire control assemblies, and mounting structures and combinations or components thereof would be welcome.

SUMMARY

According to certain aspect of the disclosure, a shotgun for firing a shell and mountable beneath a long gun may include a body member having a front end, a rear end, and a connecting structure located along a top side of the body member for attaching the body member to the long gun; a breech tube fixedly located within the body member proximate the rear end, the breach tube having at least one lateral opening though which a shell may be moved; a barrel mounted so as to be axially slidable within the body member and the breech tube, the barrel movable between a rearward position wherein a shell in the breech tube is within a chamber of the barrel and a forward position wherein a shell is loadable or unloadable from the breech tube via the at least one lateral opening; and a trigger assembly including a housing mounted to the body member proximate the rear end, the housing supporting a trigger, a firing pin, and a firing mechanism operatively interconnecting the trigger and the firing pin for actuating the firing pin when the trigger is pulled.

According to certain other aspects of the disclosure, a compact double-action trigger assembly for firing a shell in a gun may include a housing attachable to the gun and having a top, a bottom a front and a back; a firing pin mounted in the housing movable between a rest position and a firing position in which a shell in the gun may be fired; a hammer movably mounted in the housing for moving the firing pin, the hammer defining a first contact surface; a slider mounted in the housing so as to slide on an axis extending from the front to the back between a rearward position and a forward position, the slider having a second contact surface; a spring located in the housing for urging the slider in a direction toward the rearward position; and a trigger pivotally mounted in the housing generally beneath the hammer and movable between a rest position and an actuated position, the trigger when moved from the rest position partially toward the actuated position causing the slider to move toward the forward position thereby loading the spring, the trigger when moved fully to the actuated position releasing the slider so that the spring moves the slider toward the rearward position thereby using the second contact surface to contact the first contact surface and pivot the hammer so that the firing pin moves to the firing position.

According to certain other aspects of the disclosure, a compact double-action trigger assembly for firing a shell in a gun may include a housing attachable to the gun and having a top, a bottom a front and a back, the housing including a hammer compartment having a length from front to rear of less than about 1.0 inches; a firing pin mounted in the housing compartment movable between a rest position and a firing position in which a shell in the gun may be fired; a hammer movably mounted in the housing compartment for moving the firing pin, the hammer defining a first contact surface; a slider mounted in the housing so as to slide on an axis extending from the front to the back between a rearward position and a forward position, the slider having a second contact surface; a spring located in the housing for urging the slider in a direction toward the rearward position; and a trigger pivotally mounted in the housing and movable between a rest position and an actuated position, the trigger when moved from the rest position partially toward the actuated position causing the slider to move toward the forward position thereby loading the spring, the trigger when moved fully to the actuated position releasing the slider so that the spring moves the slider toward the rearward position thereby using the second contact surface to contact the first contact surface and pivot the hammer so that the firing pin moves to the firing position. As above, various options and modifications are possible.

According to certain other aspects of the disclosure, an adapter is disclosed for connecting a first object to a second object, the first object including a portion defining first grooves separated by first ridges in a repeating pattern, a width of each first groove being substantially identical, a width of each first ridge being substantially identical so that a first pitch of the first grooves is substantially equal along the portion. The adapter may include a rail member defining second grooves separated by second ridges in a repeating pattern, a width of each second groove being substantially identical and substantially identical to the width of the first grooves, a second pitch of at least some of the second grooves being different than the first pitch so that a ratio of a pitch unit length of the second pitch to a pitch unit length of the first pitch is a non-whole integer ratio whereby the adapter is connectable to the portion in multiple relative orientations by alignment of at least one of the first grooves with at least one of the second grooves to form a passageway, the multiple relative orientations being separated from each other by a distance smaller than the first pitch; and a connector insertable through the passageway for securing the rail member to the portion thereby connecting the first object to the second object.

According to certain other aspects of the disclosure, a multipurpose connector for connecting a first object to a second object may include a first rail member defining first grooves separated by first ridges in a repeating pattern, a width of each first groove being substantially identical, a width of each first ridge being substantially identical so that a first pitch of the first grooves is substantially equal along the portion; a second rail member defining second grooves separated by second ridges in a repeating pattern, a width of each second groove being substantially identical and substantially identical to the width of the first grooves, the first rail member and the second rail member being configured for contacting each other so that at least one of the first grooves is alignable with one of the second grooves to create a passageway between the first and second rail members; a second pitch of at least some of the second grooves being different than the first pitch so that a ratio of a pitch unit length of the second pitch to a pitch unit length of the first pitch is a non-whole integer ratio whereby the first rail member is connectable to the second rail member in multiple relative orientations by alignment of at least one of the first grooves with at least one of the second grooves to form a passageway, the multiple relative orientations being separated from each other by a distance smaller than the first pitch; and a connector insertable through the passageway for securing the first rail member to the second rail member thereby connecting the first object to the second object.

BRIEF DESCRIPTION OF THE DRAWINGS

More details of the present disclosure are set forth in the drawings.

DETAILED DESCRIPTION

Detailed reference will now be made to the drawings in which examples embodying the present disclosure are shown.

The present disclosure is directed to many interrelated aspects of a modular shotgun, an underbarrel shotgun, a combinable shotgun and long gun, a compact trigger assembly, a multifunction mounting assembly, an adapter for a mounting assembly, and various combinations and subcombinations of such elements. Thus, it should be understood that the various embodiments of such items are examples only, and that numerous other modifications and combinations can be employed using the teachings of the present disclosure to carry out aspects of the many inventions disclosed herein.

Figure 1:
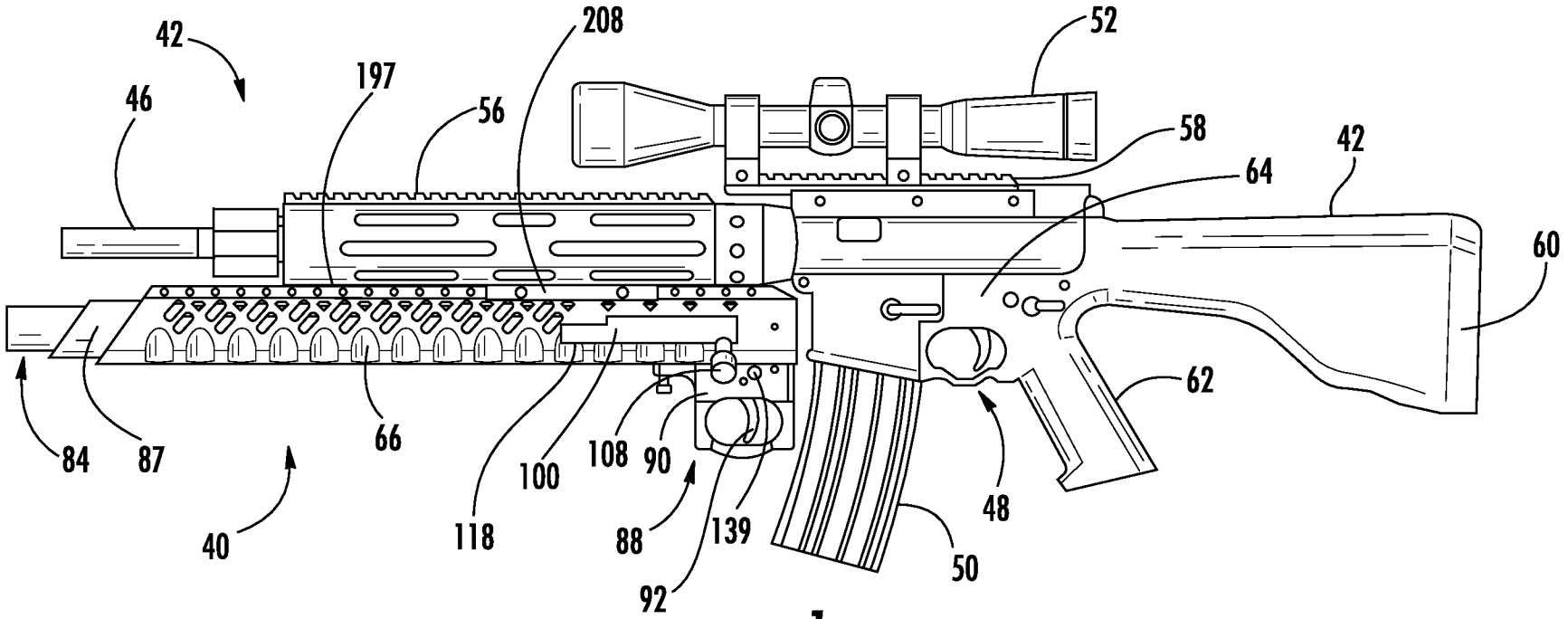
FIG. 1 is a side view of a shotgun mounted beneath a long gun according to certain aspects of the disclosure.
Figure 2:
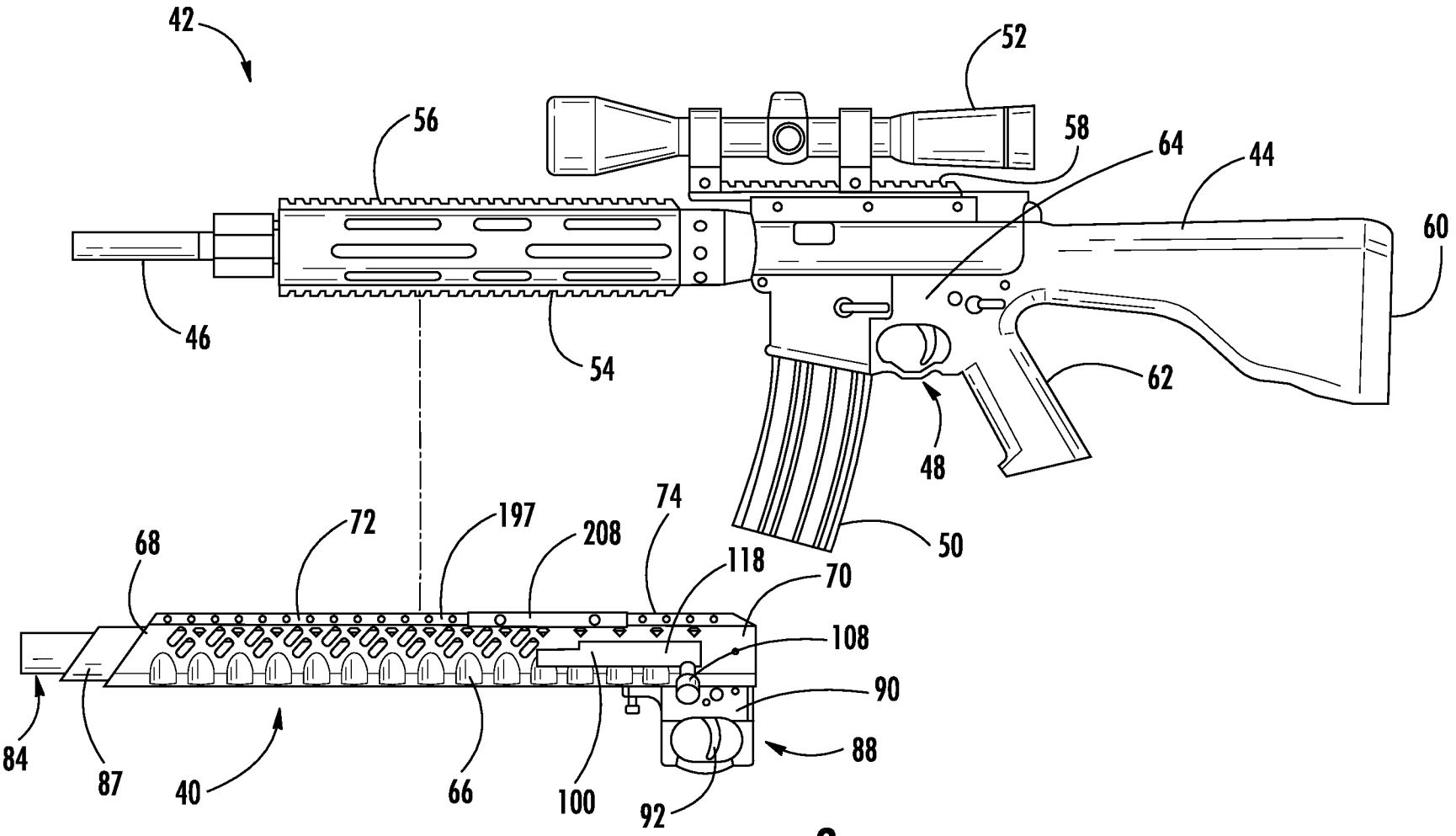
FIG. 2 is a side view of the shotgun and long gun of FIG. 1 after separation.

FIG. 1 shows a shotgun 40 mounted beneath a long gun 42, and FIG. 2 shows the shotgun separated from the long gun. Long gun 42 is illustrated as a semi-automatic rifle having components such as a stock 44, a barrel 46, a fire control unit (i.e., trigger assembly) 48, and a magazine 50. Accessories such as a sighting scope 52 or other elements may be attached via a permanent or removable connection, such as mounting rail or other connector (three accessory mounting rails 54, 56, 58 having an alternating ridge/channel Picatinny-type profile are depicted). Stock 44 may be a unitarily formed element or may include partially or fully assembled-together elements such as the illustrated butt 60, grip 62, and forend 64.

It should be understood that long gun 42 could be any type of long gun, such as a rifle, shotgun, carbine, musket, machine gun, sub-machine gun, etc., longer than a handgun to which shotgun 40 may be attached. Accordingly, the use of the term "long gun" herein within the description and claims is intended to refer to any such gun and not only the example depicted. Further detailed description of long gun 42 is thus not necessary for comprehension of the various inventions disclosed herein, and for brevity only aspects necessary for such comprehension will be discussed below.

Certain elements of shotgun 40 are introduced briefly below, and are then described in more detail as required. Shotgun 40 as illustrated includes a body member 66 having a front end 68, a rear end 70, and a connecting structure 72 located along a top side 74 of the body member for attaching the body member to long gun 42. A breech tube 76 is fixedly located within body member 66 proximate rear end 70. Breech tube 76 has at least one lateral opening though which a shell 78 may be moved for loading and/or unloading into the breech 79. As illustrated, breech tube 76 has two lateral openings on opposite sides of breech 79: a first opening 80 for loading a shell, and a second opening 82 for discharging a shell.

Figure 27:
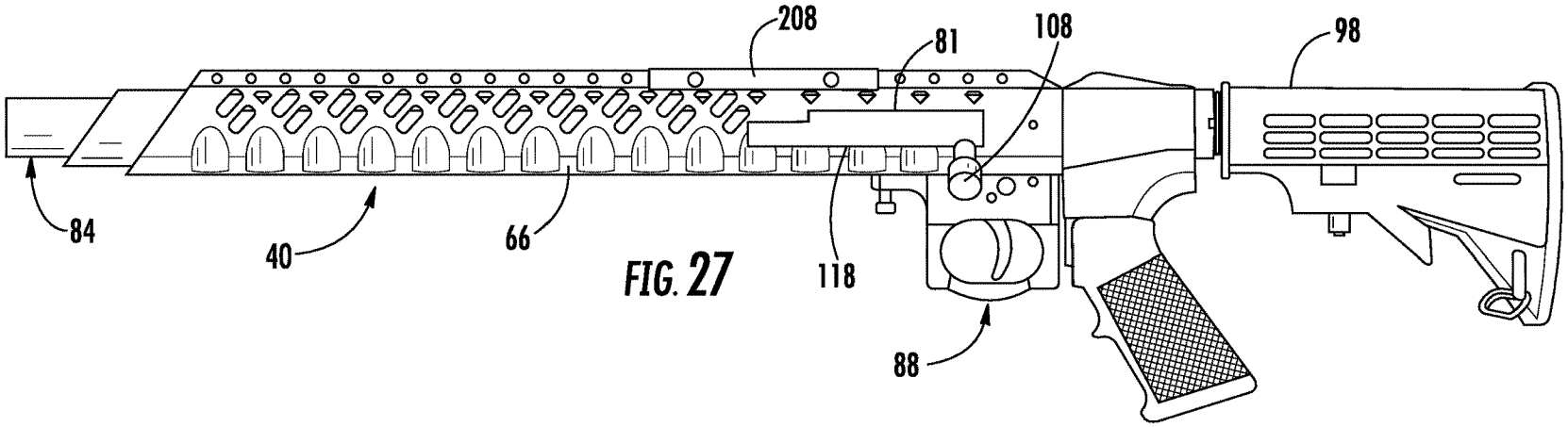
FIG. 27 is a side view of the shotgun as in FIG. 1, removed from the long gun and with a head stock attached for independent use as a shotgun.
Figure 28:
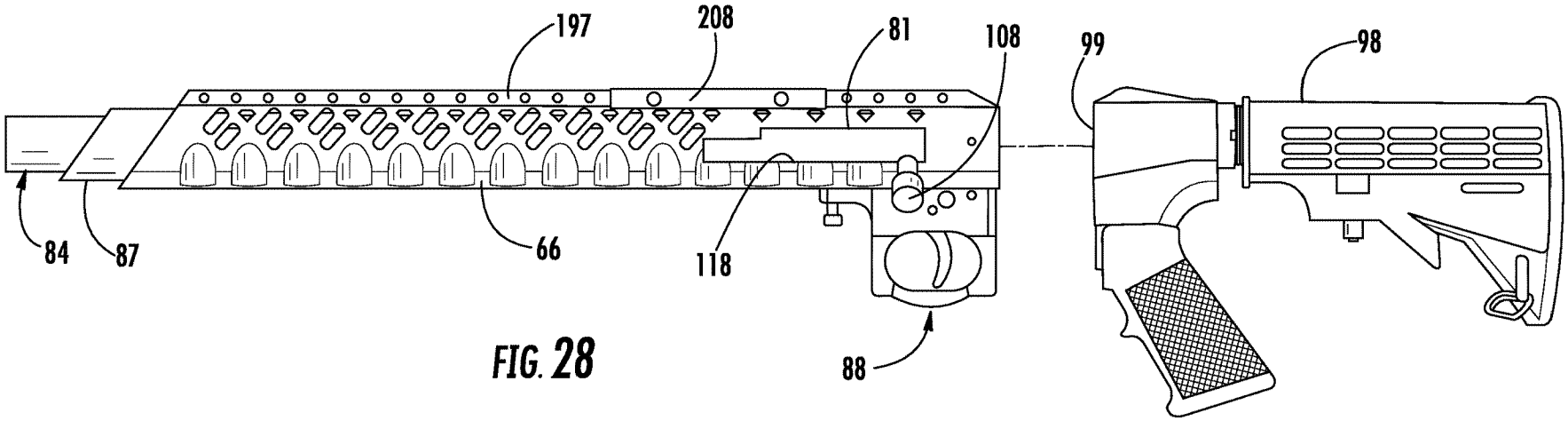
FIG. 28 is a side view of the shotgun as in FIG. 27, showing detachment of the head stock.

To comply with the United States National Firearms Act (USNFA) to thereby allow private citizen ownership of such a compact shotgun, it is required that a shotgun have barrel length no shorter than 18 inches or an overall length no shorter than 26 inches. Thus, to meet such standards, barrel 84 may have a length of at least 18 inches. If shotgun 40 is to be used separately from long gun 42, a stock 98 (FIGS. 27 and 28) may be provided having a fore end 99 attachable to trigger assembly 88. When stock 98 is attached to the rest of shotgun 40, a length of the assembled shotgun should thus be at least 26 inches to meet USNFA requirements. For example, if barrel 84 is 18 inches long, then stock 98 must be at least 8 inches long. It should be understood that various other lengths of these components and overall lengths are possible to thereby allow private citizen ownership in the United States. However, the full scope of the invention is not necessarily limited the disclosed dimensions or to the above USNFA requirements, and aspects of this disclosure are applicable to guns for non-USNFA uses, such as military, non-domestic uses, etc.

Barrel 84 includes a chamber portion 100 a forward portion 102 adjacent the chamber portion. Chamber portion 100 includes the chamber 86, a first barrel section 104, and a conventional forcing cone 106 between the chamber and the first barrel section.

Figure 4:
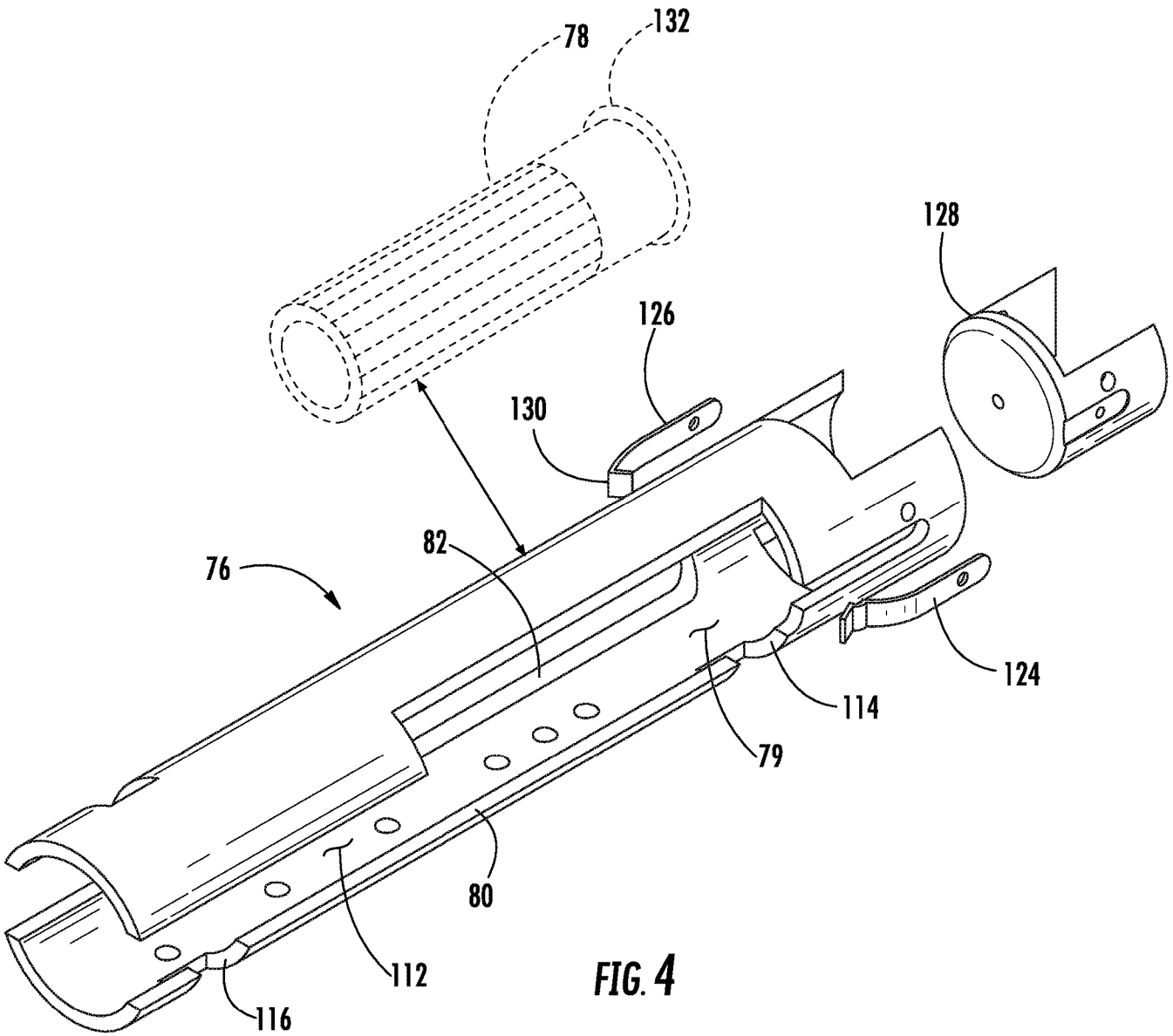
FIG. 4 is an exploded isometric view of the breech tube assembly as in FIG. 3.
Figure 5:
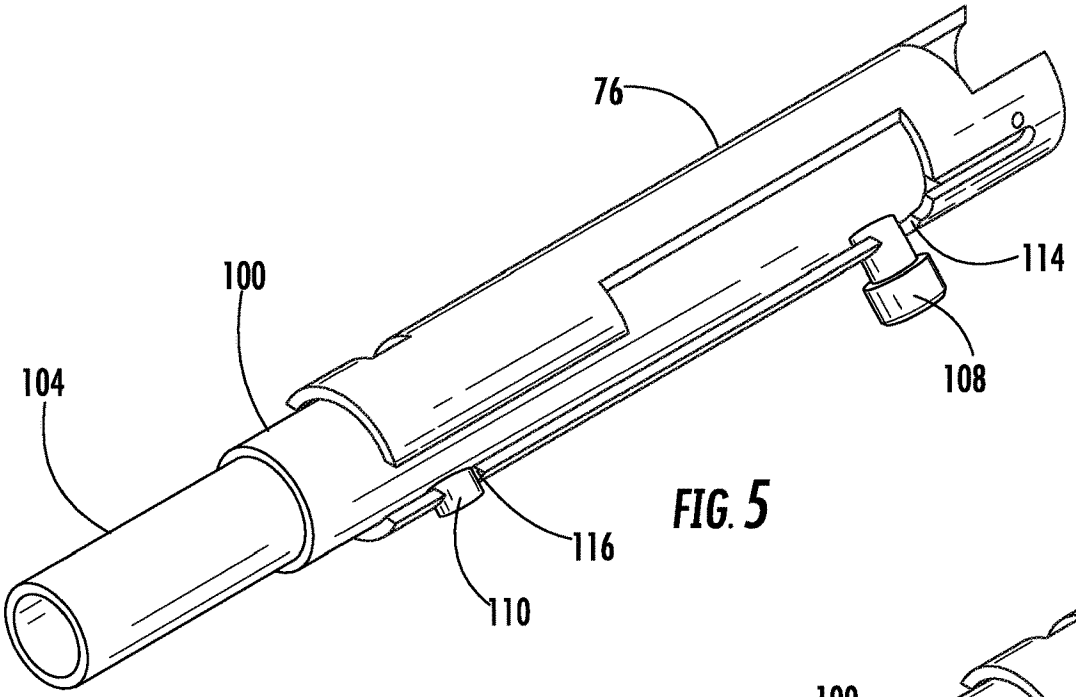
FIG. 5 is an isometric view of the chamber portion of the barrel of the shotgun as in FIG. 3 within the breech tube in a first (firing) position.

In one embodiment (FIG. 7), barrel 84 may be formed from two pieces such as a chamber (rearward) portion 100 and barrel (forward) portion 102, is mounted so as to be axially slidable within body member 66 and breech tube 76. Barrel 84 is movable between a rearward position (FIG. 5) wherein a shell (see FIG. 4) in breech tube 76 is within a chamber 86 of the barrel and a forward position (FIG. 6) wherein a shell is loadable or unloadable from the breech tube via the lateral opening(s) 80,82.

Figure 7:
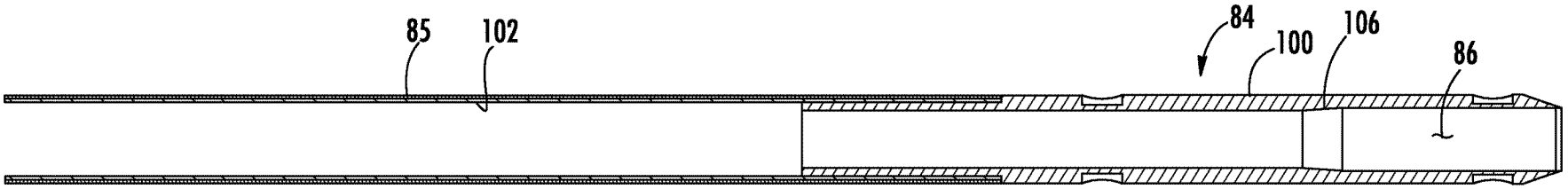
FIG. 7 is a cross-sectional view of the barrel of the shotgun as in FIG. 3.

As shown in FIG. 7, barrel 84 forward portion 102 may be a metal (steel) tube attached (e.g., welded) to the metal (steel) chamber portion 100. If so, forward portion 102 may have a larger diameter than forend 99 of chamber portion. In particular, chamber portion 100 may be sized with a 12-gauge bore and forward portion 102 may be sized with a 10-gauge bore. The diameters may be over-bored slightly, as for example would be suitable for home defense. Forcing cone 106 is located in chamber portion 102 forward of chamber 86. Forward portion 102 may include a choke at the distal end if desired, to tighten up the resulting shot pattern, or it may be unchoked as illustrated in FIG. 7. An optional sleeve 85, for example, made of a carbon fiber composite material or the like, may be fit over forward portion 102 to assist with reducing weight, guiding and sliding barrel 84 along and within bushing 87 mounted within body member 66, and/or for decorative purposes. Bushing 87 may also be a carbon fiber and/or plastic. If no sleeve 85 is provide, forward portion 102 may optionally be made thicker so that the outer diameter matches that of chamber portion 102, if desired.

Figure 8:
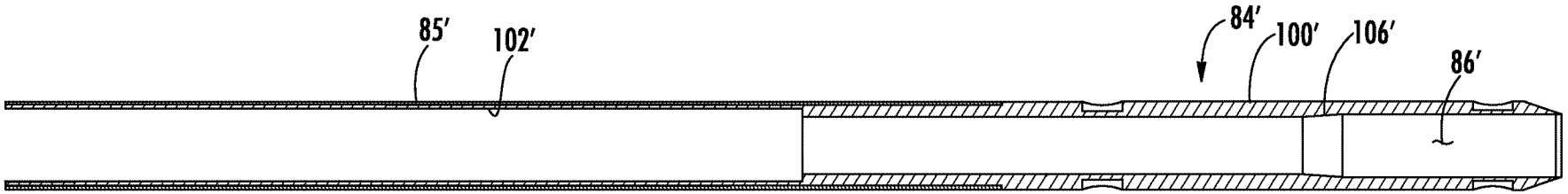
FIG. 8 is a cross-sectional view of an alternate shotgun barrel that may be substituted for that of FIG. 3.
Figure 9:
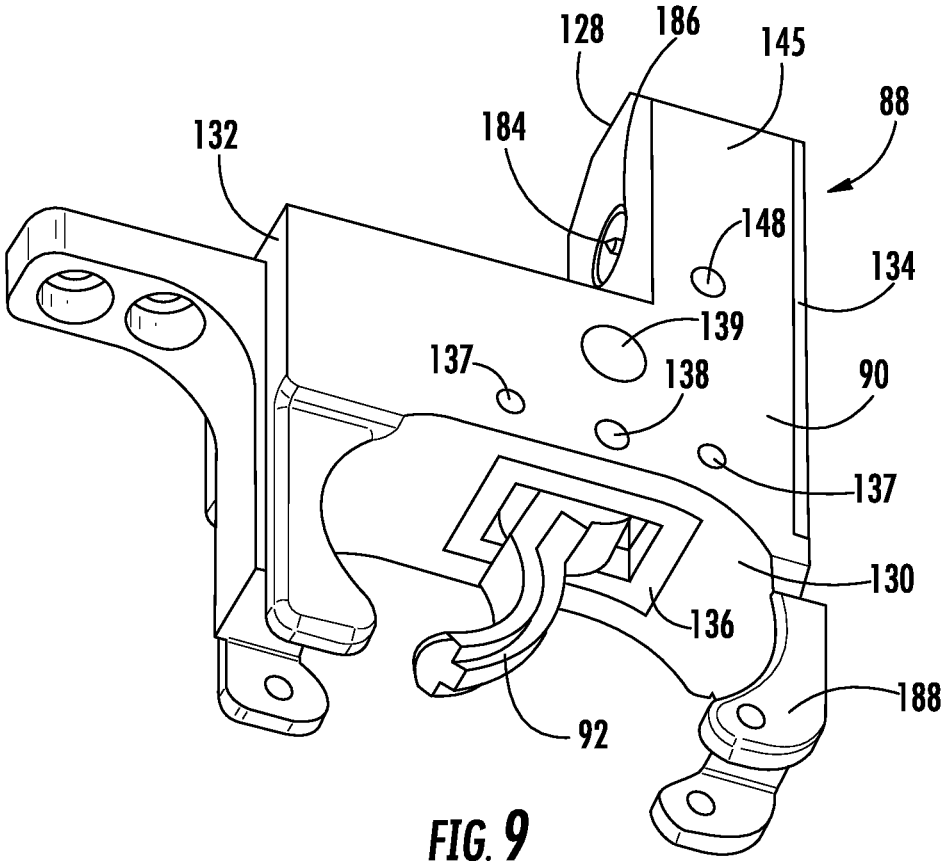
FIG. 9 is an isometric view of the fire control unit of the shotgun, with the trigger guard removed for clarity.

An alternate barrel 84' is shown in FIG. 8. In barrel 84', chamber portion 100' and forward portion 102' are formed of one unitary piece of metal (steel). As illustrated, differing bore sizes may be provided in chamber portion 100' and forward portion 102' if desired (for example, by boring to different sizes), with forcing cone 106' just downstream of chamber 86'. Again, forward portion 102' may be unchoked (as illustrated) or choked. An optional sleeve 85' is provided, although it could be eliminated with this embodiment as well.

If chamber portion 100 of barrel 84 has a length of approximately 9.5 inches, and forward portion 102 and optional (sleeve 85) have a length of 11.25 inches, with an overlap axially of about 2.0 inches, the axial length of barrel 84 is about 18.75 inches, although differing barrel lengths (both above and below the 18 inch USFNA limit) are possible. Similar dimensioning is possible for barrel 84'. Such compact sizing assists with making shotgun suitable for underbarrel use.

A trigger assembly 88 includes a housing 90 mounted to body member 66 proximate rear end 70. Housing 90 may be formed in several parts and supports a trigger 92, a firing pin 94, and a firing mechanism 96 operatively interconnecting the trigger and the firing pin for actuating the firing pin when the trigger is pulled.

As noted, barrel 84 slides linearly relative to breech tube 76 and generally the rest of shotgun 40 to open and close breech 79. To allow a user to do so, a handle 108 and follower 110 are attached to chamber portion 100 of barrel 84. An axial slot 112 is located along breech tube 76 and includes laterally (circumferentially) located receivers 114, 116 spaced receiving handle 108 and follower 110. An axial slot 118 formed in body member 66 is located correspondingly to slot 112 in breech tube 76, with a lateral (circumferential) receiver 119 for handle 108. First and second openings 81,83 formed along slot 118 corresponding to openings 80,82 in breech tube 76 to allow loading and unloading of a shell relative to breech 79.

Figure 6:
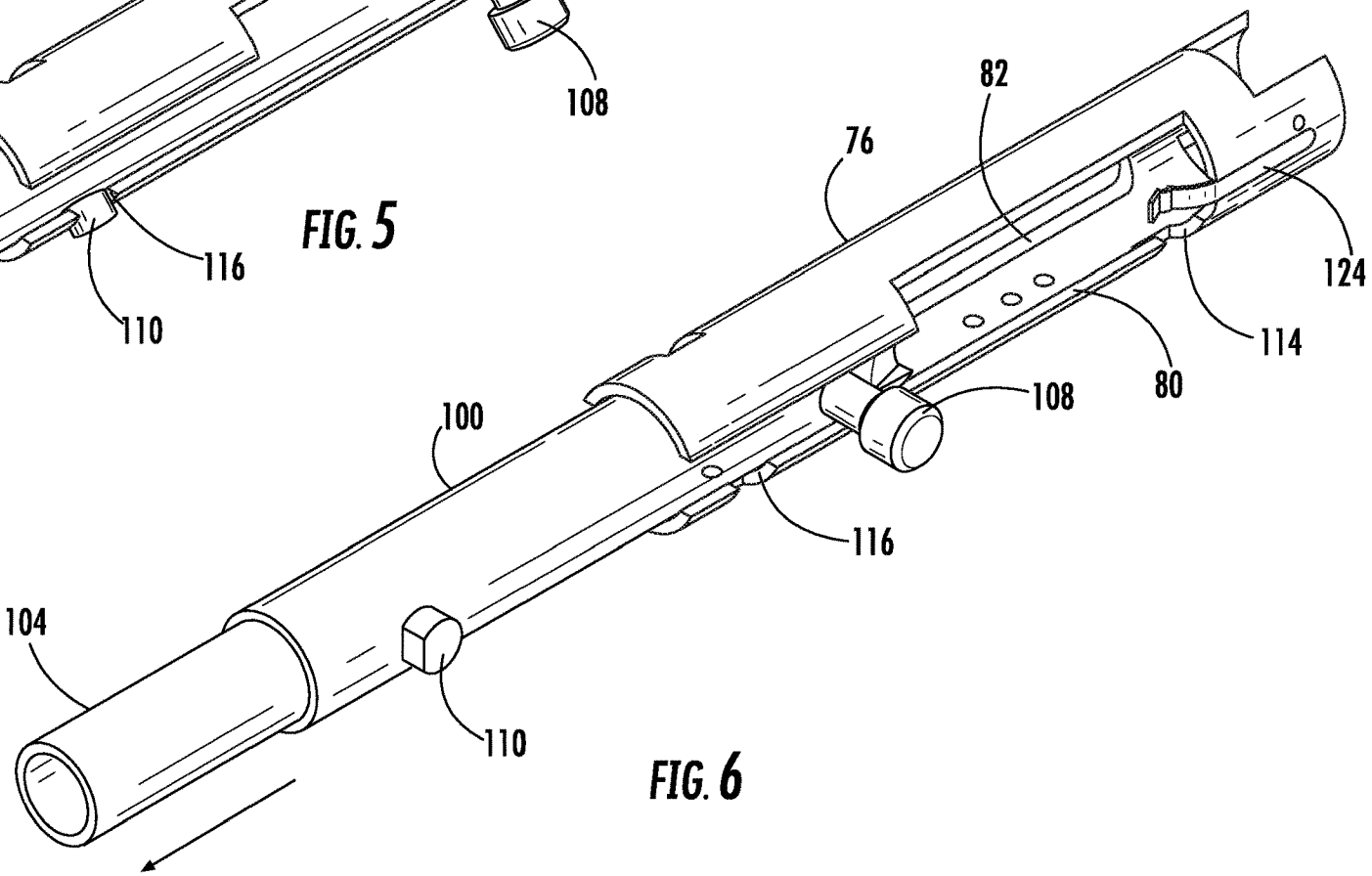
FIG. 6 is an isometric view of the chamber portion of the barrel of the shotgun as in FIG. 3 within the breech tube in a second (loading) position.
Figure 23:
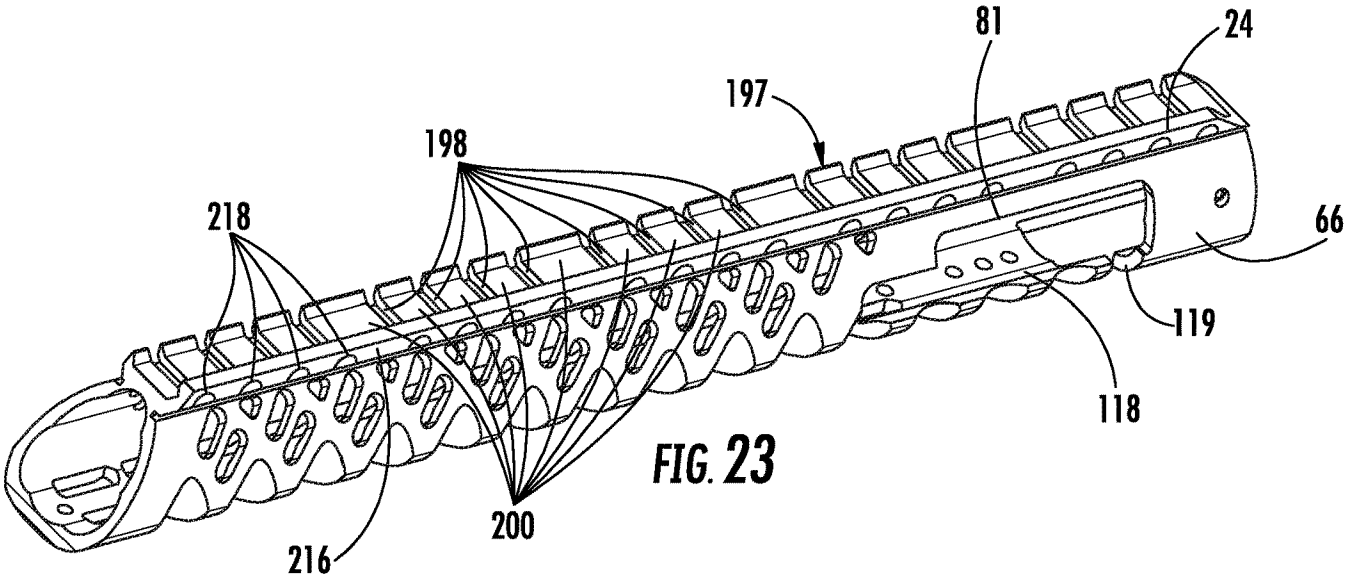
FIG. 23 is a top left-side isometric view of the handguard.
Figure 24:
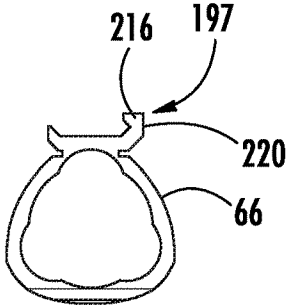
FIG. 24 is a sectional view through the handguard taken along line 24-24 in FIG. 22.
Figure 25:
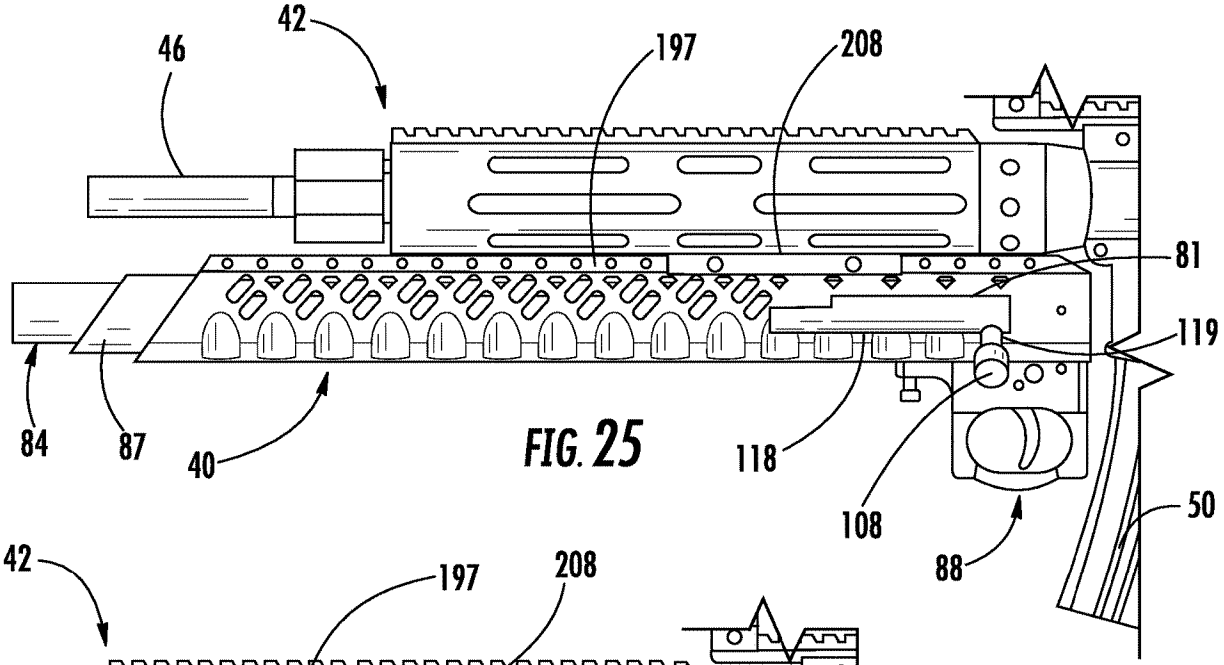
FIG. 25 is an enlarged side view of the shotgun and long gun of FIG. 1 with the shotgun barrel in a first position.
Figure 26:
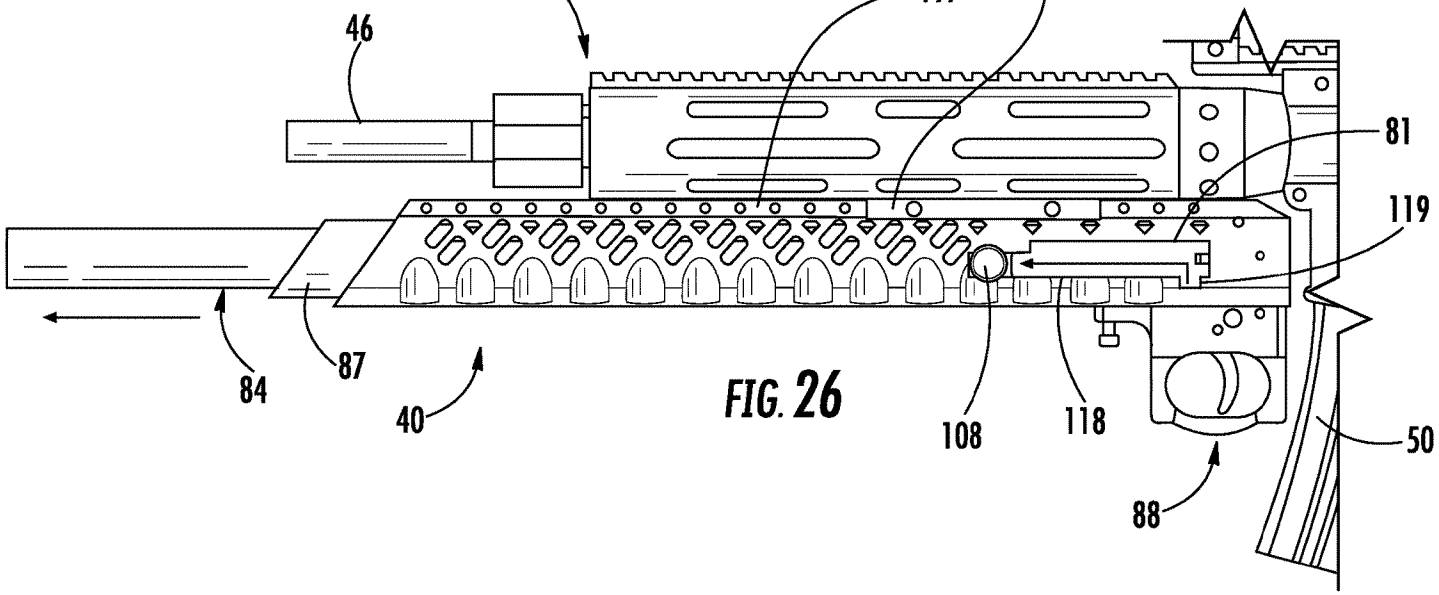
FIG. 26 is an enlarged side view of the shotgun and long gun of FIG. 1 with the shotgun barrel in a second position.

To open a closed breech 79 with barrel 84 in the rearward orientation (FIGS. 5 and 23), the user grasps handle 108 to rotate the barrel and move the handle and follower 110 out of receivers 114,116, 119. The user then uses handle 108 to slide barrel 84 axially forward, guided by follower 110 and handle 108 sliding along slots 112,118 until the handle reaches forward end 120 of slot 2 112,118 (FIGS. 6 and 24). To close breech 79, the user moves barrel 84 rearward until handle reaches rear end 122 of slots 112,118, at which point the barrel can be rotated to place handle and the follower 110 back into receivers 114,116,119.

To hold an unfired shell 78 in breech 79 and to assist in removal of the shell after firing, at least one extractor may be attached to breech tube 76. As illustrated, extractors 124,126 are attached to end cap 128 attached to breech tube 76 and extend generally axially along breech 79. Extractors 124,126 are formed as flexible leaf springs of differing lengths and shapes, with shorter extractor 126 having a hook 130 on an end. As chamber portion 100 of barrel 84 is moved axially forward after firing, friction between the inside of breech tube 76 and shell 78 will draw the shell forward until a rear flange 132 of the shell contacts and pivots slightly around hook 130. By further moving breech tube 76 forward with rear flange 132 held axially by hook 130, shell 78 will pivot out of lateral opening 82 on the side of breech tube 76 on which extractor 126 is located. The user can then remove the spent shell and insert a new one via lateral opening 80, followed by moving barrel 84 back to its rearward and rotated position to chamber the next shell.

Sizing of certain above portions of shotgun 40 allows for a compact underbarrel arrangement. For example, chamber portion of barrel 84 may have an axial length of about 9.5 inches. Such length is sufficient for firing a shell without negatively impacting the length of the remainder of barrel 84 while compact enough to contribute to the underbarrel mounting. Also, trigger assembly 88 is formed compactly so that, when attached to barrel 84 it may extend rearwardly past the rear end of the barrel a small amount, for example less than about 1.0 inches. Thus, the combined axial length of shotgun 40 (configured for underbarrel mounting, without stock 98) measured between a front end of barrel 84 and a rear end of trigger assembly 88 is less than about 19.0 inches. Such compact sizing complies with USNFA requirements while also allowing for an efficient and intuitive underbarrel configuration where trigger assembly is located in front of magazine 50 of long gun 42. Magazine 50 can thus be also used as a grip for the hand used on trigger assembly 88 of shotgun 40.

Trigger assembly 88 as illustrated herein is one efficiently sized design that may provide such benefits. As shown trigger assembly 88 is a double-action trigger assembly with a firing mechanism 96 connecting trigger 92 and firing pin 94, although other double-action or single-action trigger assemblies could be substituted in some aspects of the disclosure.

Trigger assembly housing 90 has a top 128, a bottom 130, a front 132, and a back 134. A sub-housing 136 may be attachable to bottom 130 by pins 137 for attaching an assembly including trigger 92, trigger axle 138 on which trigger pivots and sear 140 pivotally attached to a top end of trigger 92 via sear axle 142. Conventional sliding safety 139 prevents movement of trigger 92 when in a blocking position. Firing pin 94 is pivotally mounted to a hammer 144 via a firing pin axle 146, and hammer 144 is in turn pivotally mounted within a hammer compartment portion 145 of housing 90 via a hammer axle 148. Axles 138, 142 and 146 may be pins attached to their respective elements, or may be formed integrally with such elements.

A slider 150 is mounted in the housing so as to slide on an axis extending from housing front 132 to housing back 134, and a compression spring 152 between front 132 and a pocket 154 in slider 150 urges the slider toward the back. A bushing 156 toward housing front 132 and an axial guide pin 158 extending from housing back 134 through a hole 160 on a stop tab 162 on slider 150 help guide the slider back and forth within the housing. A first contact surface 164 on hammer 144 is located for contact by second contact surface 166 on slider 150. Sear 140 has a protrusion 168 at its forward end for contacting a third contact surface 170 on slider. Trigger 92 has a fourth contact surface 172 for contacting a fifth contact surface which may be a pin 174 mounted in a slot 176 at the rearward end of sear 140.

Figure 10:
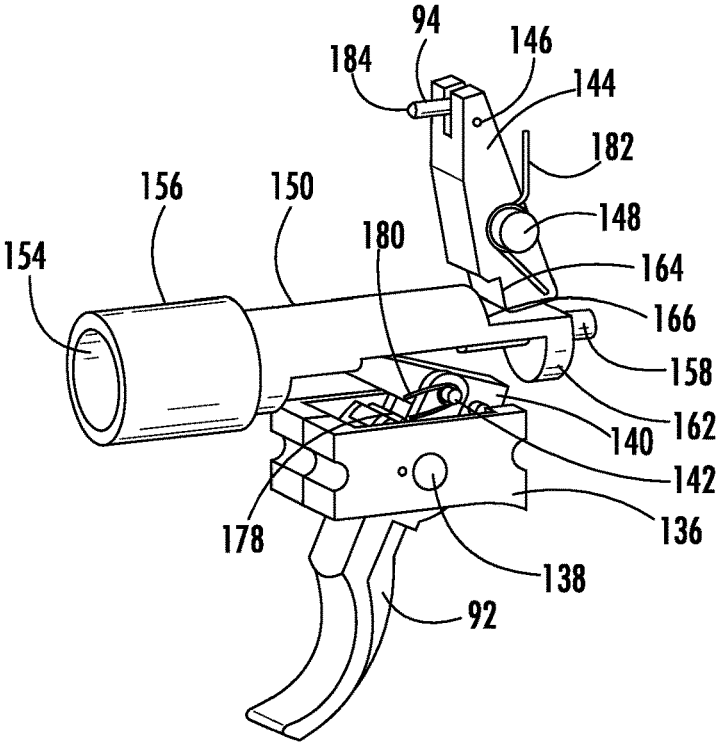
FIG. 10 is an isometric view of functional portions of the fire control unit, with the housing removed for clarity.
Figure 11:
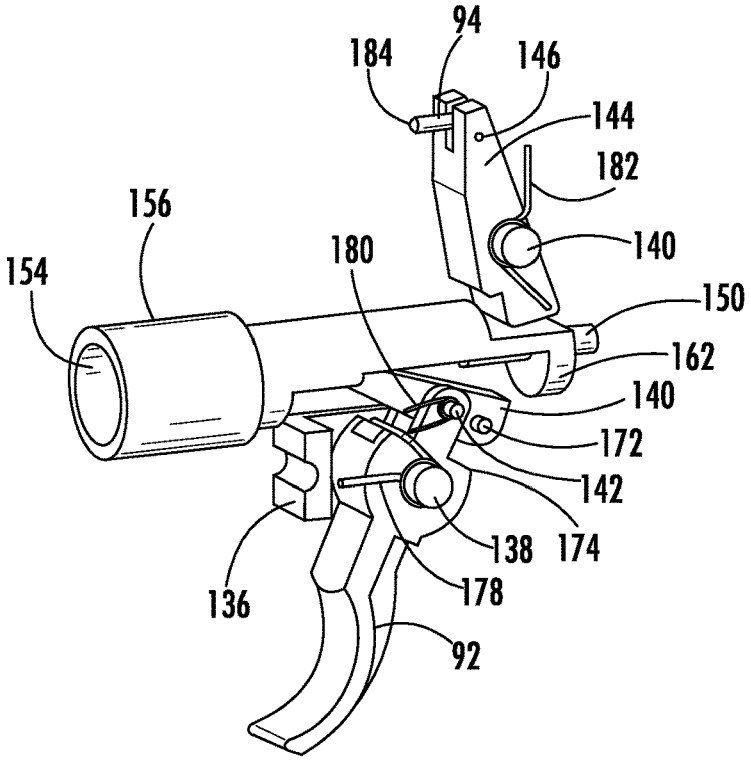
FIG. 11 is an isometric view as in FIG. 9, with trigger mount elements also removed for clarity.

FIGS. 12-19 show in detail the process by which trigger assembly 88 is moved from a rest/unactuated position to a firing position and then back to a rest position. As shown in FIG. 10, trigger 92 is in the rest position, fourth contact surface FIG. 12 172 of trigger 92 is not in contact with pin 174 on sear 140, sear protrusion 168 is in contact with third contact surface 170 of slider 150, and second contact surface 166 of slider 150 is in contact with first contact surface 164 of hammer 144. Relative to housing 90, compression spring 152 urges slider rightward (in FIG. 12), a trigger coil spring 178 urges trigger 92 to rotate counterclockwise around trigger axle 138 toward the rest position, a sear coil spring 180 urges sear to rotate clockwise around sear axle 142 so that protrusion 168 contacts slider 150, and a hammer coil spring 182 urges hammer 144 to rotate clockwise around hammer axle 148 so that hammer first contact surface 164 contacts slider second contact surface 166. Note that when firing pin 94 is in the position of FIG. 12, tip 184 of firing pin is retracted within housing 90 behind opening 186 so that tip 184 does not protrude through opening 186 and therefore cannot contact a shell placed in chamber 86 (directly in front of opening 186).

Figure 12:
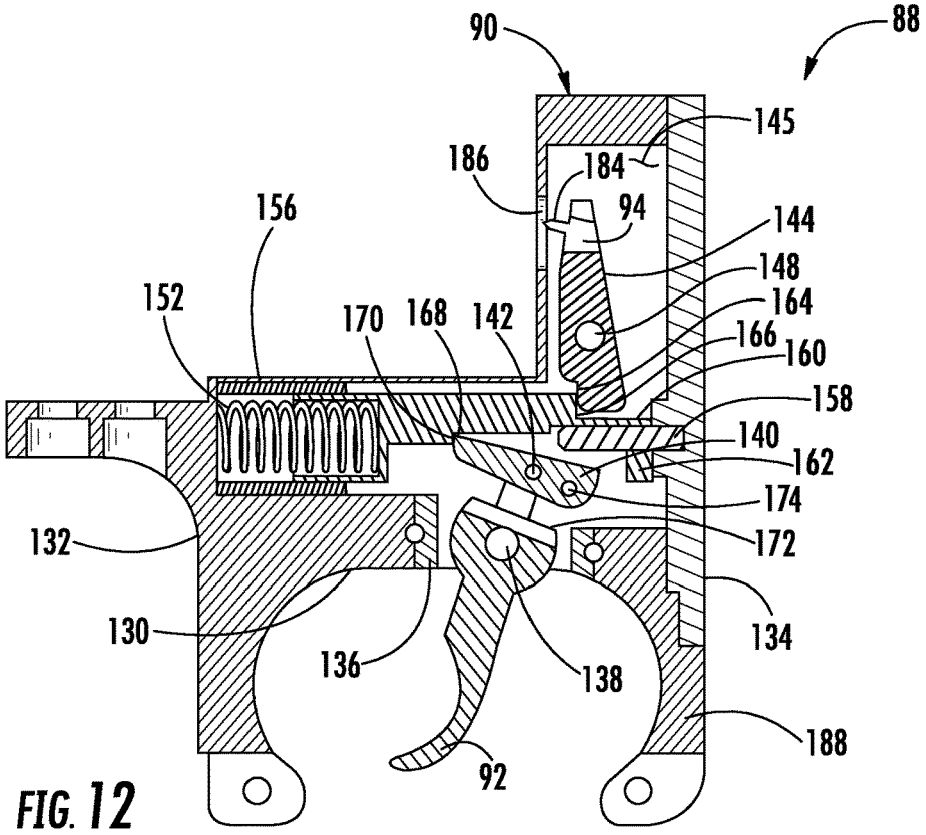
FIG. 12 is a cross-sectional schematic view showing the fire control unit with the trigger (and all other movable parts) in an unactuated position, and removing the safety elements for clarity.
Figure 13:
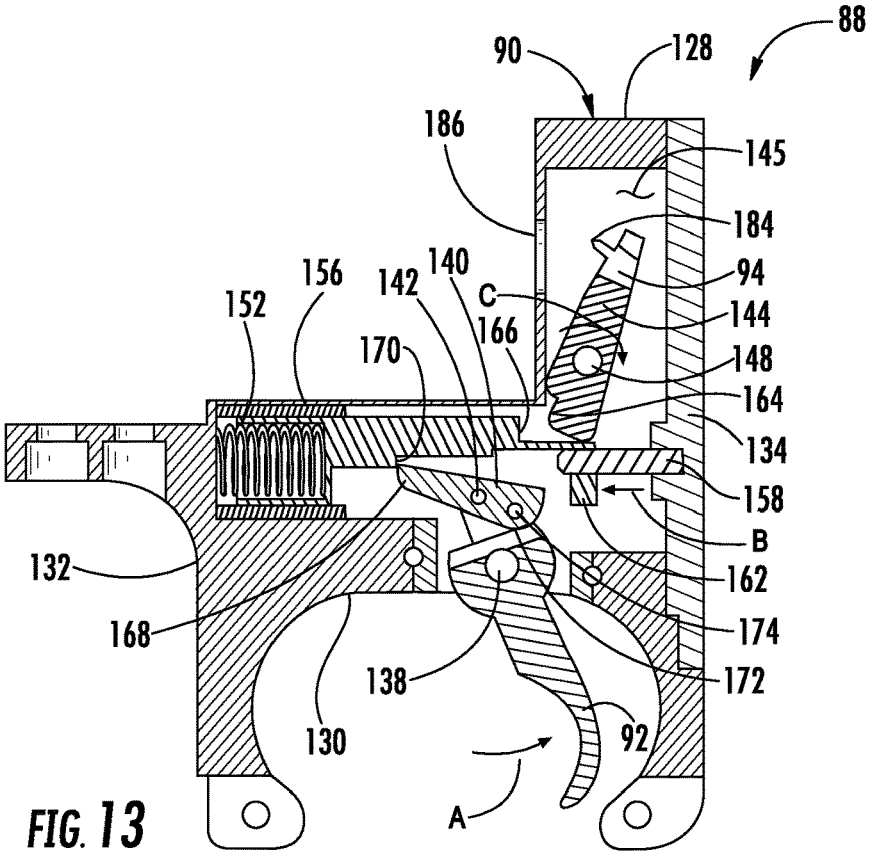
FIG. 13 is a cross-sectional schematic view as in FIG. 12, with the trigger moved from the unactuated position a first amount.

Between FIGS. 12 and 13, as the user begins to pull trigger 92 to fire the gun, trigger 92 moves (counterclockwise) on axle 138 (arrow A) taking sear 140 with it, sear 92 rotates slightly clockwise relative to trigger 92, pin 174 on sear 140 has been contacted by fourth contact surface 172 on trigger 92, protrusion 168 which has also rotated slightly counterclockwise relative to (but still contacts) third contact surface 170 moves slider 150 to the left (arrow B) compressing spring 152 and moving second contact surface 166 away from first contact surface 164 on hammer 144 thereby allowing hammer 144 to rotate clockwise (arrow C) relative to housing 90 to a rest position.

Figure 14:
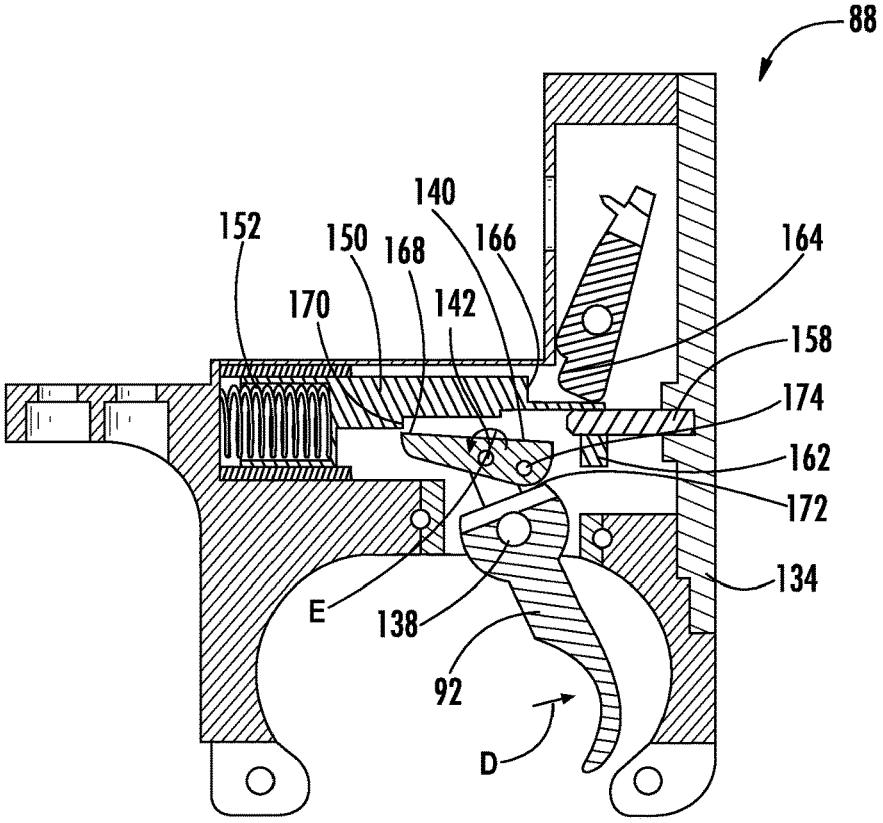
FIG. 14 is a cross-sectional schematic view as in FIG. 12, with the trigger moved from the unactuated position a second amount in which a seer first loses contact with a slider.

Between FIGS. 13 and 14, as the user pulls trigger 92 further to the actuated position (arrow D), pin 174 contacting fourth contact surface 172 of sear causes sear 140 to move with trigger 92 until protrusion 168 no longer contacts third contact surface 170 of slider 150 (arrow E). Once protrusion 168 is clear of slider 150, compression spring 152 starts moving slider 150 rapidly rearward.

Figure 15:
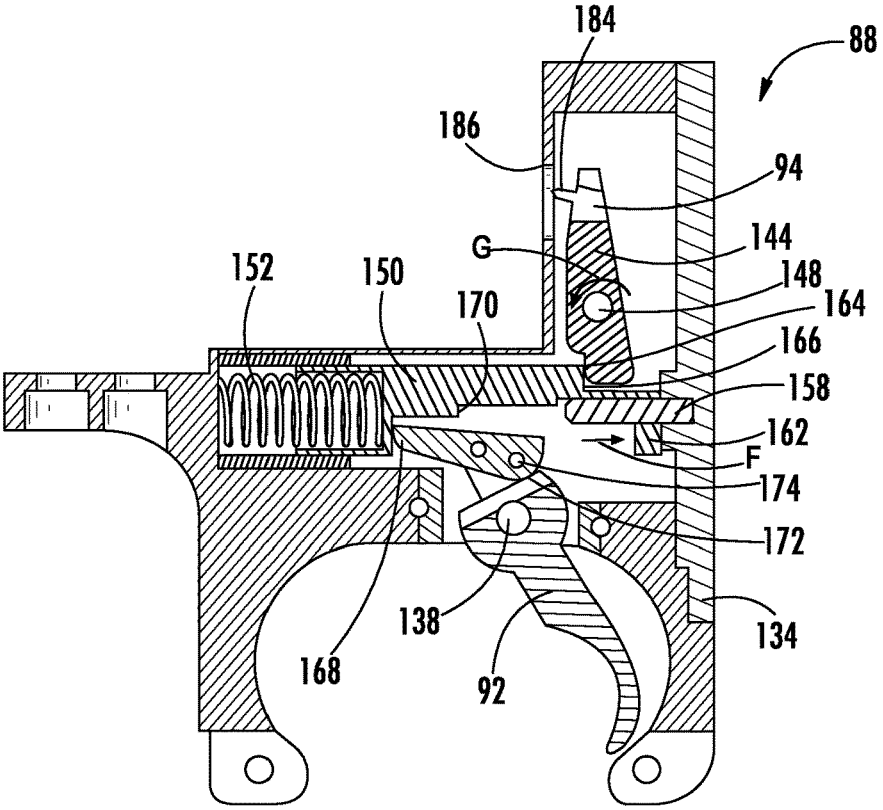
FIG. 15 a cross-sectional schematic view as in FIG. 12, with the trigger moved from the unactuated position a third amount (to an actuated position), wherein the slider has moved to initiate contact with a hammer.

In FIG. 15, slider 150 has moved sufficiently (arrow F) that second contact surface 166 of slider 150 has hit first contact surface 164 of hammer 144 and begun to rotate hammer 144 (arrow G). Tab 162 has hit back 143 of housing 90, acting as a stop for slider 150.

Figure 16:
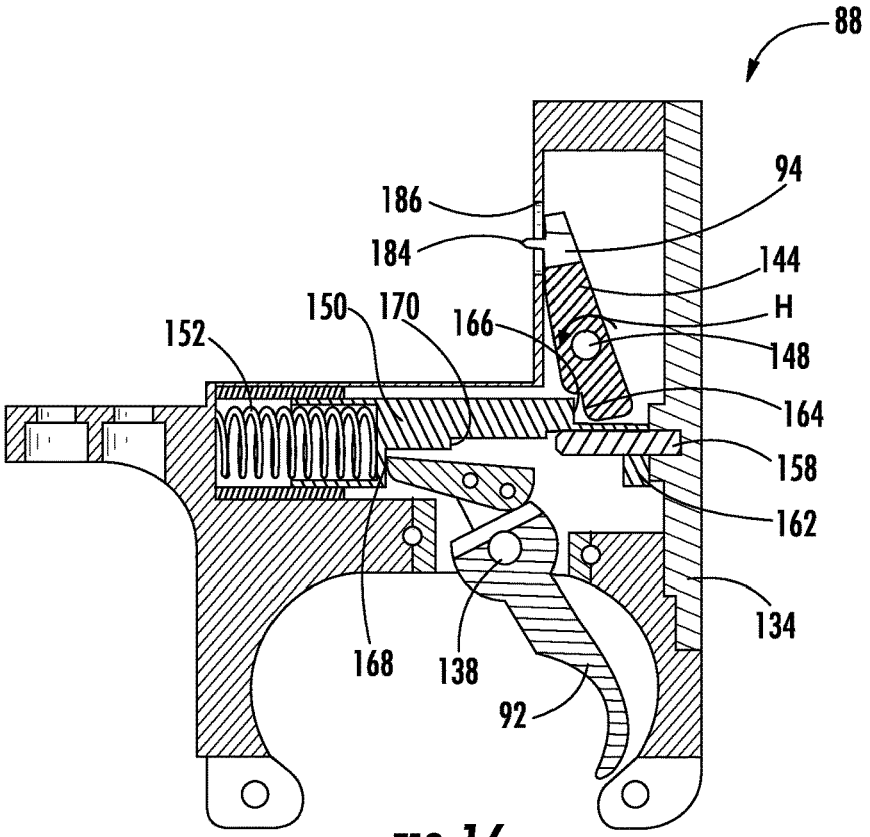
FIG. 16 is a cross-sectional schematic view as in FIG. 12, with the trigger still in the actuated position and the hammer rotated so as to lose contact with the slider and to move a firing pin therein into a firing position.

In FIG. 16, the force from moving slider 150 has overcome the light force provided by hammer coil spring 182 and caused hammer 144 to rapidly rotate clockwise (arrow H) sufficiently that firing pin tip 184 is fully extended from opening 186 into a firing position within chamber 86 so as to be able to fire a shell within the chamber.

Figure 17:
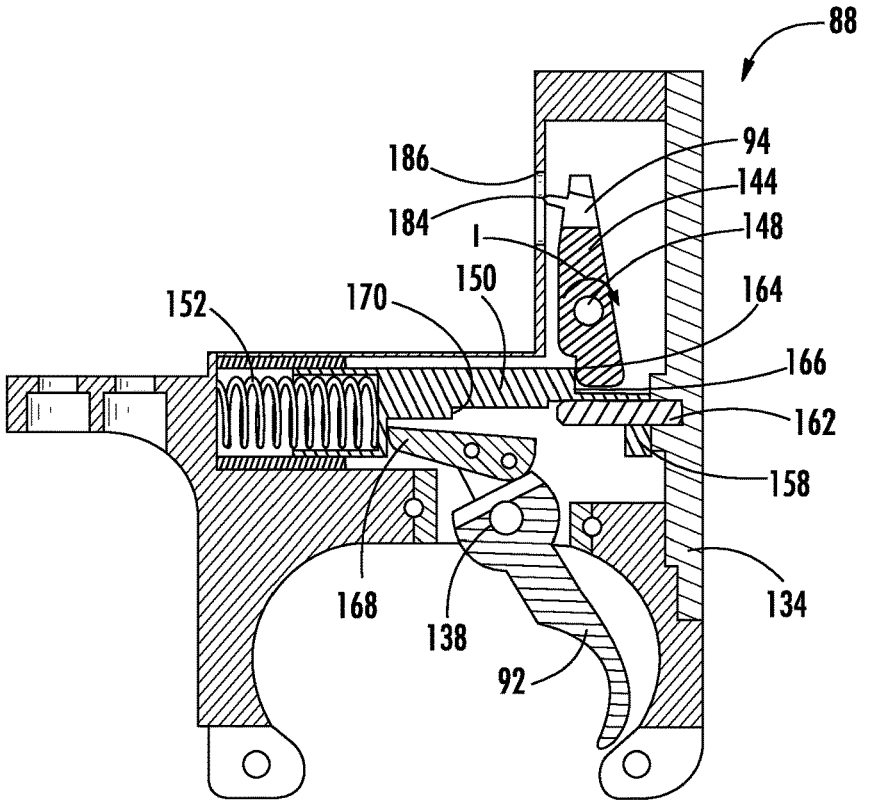
FIG. 17 is a cross-sectional schematic view as in FIG. 16, with the hammer moving back to contact the slider.

In FIG. 17, hammer coil spring 182 has returned hammer 144 and firing pin 94 to the position of FIG. 13 (between the rest and firing position), where surfaces 164 and 166 are back in contact and firing pin tip 184 is back inside housing 90 (arrow I). Other elements are substantially unchanged. As the movement from FIGS. 13-15 occurs very rapidly under the influence of springs 152 and 182 during firing, the user would not yet have released trigger 92 from the actuated position.

Figure 18:
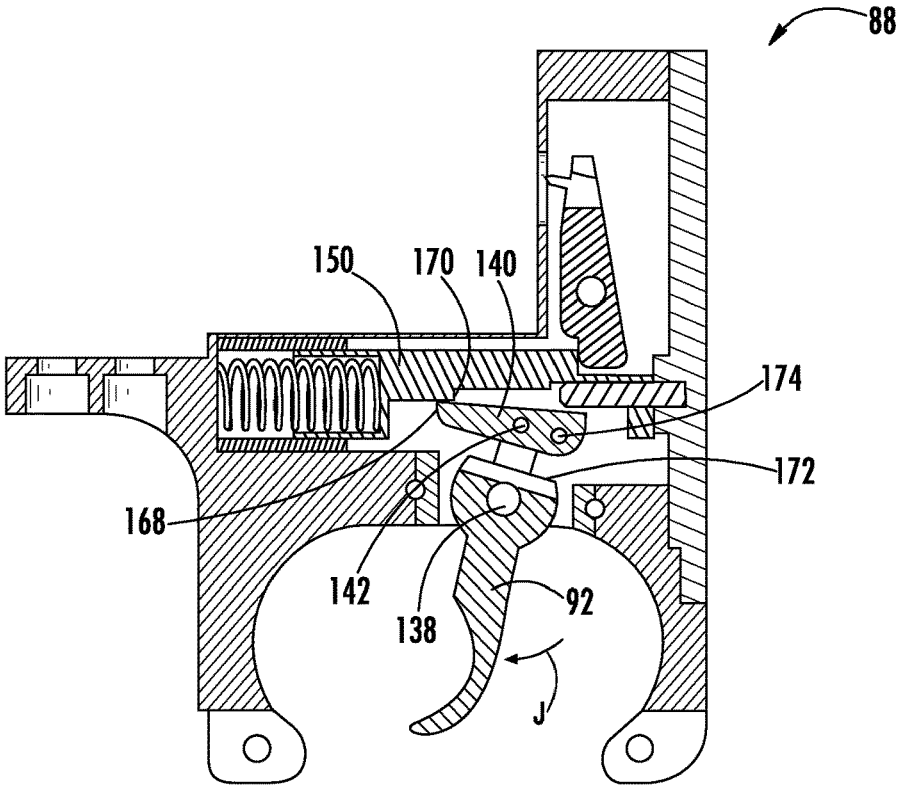
FIG. 18 is a cross-sectional schematic view as in FIG. 12, with the trigger moved back partially from the actuated position toward the unactuated position.

In FIG. 18, the user has begun to release trigger 92. Trigger coil spring 178 has rotated trigger 92 clockwise (arrow J) and sear 140 relative to housing 90 so that pin 174 is out of contact with fourth contact surface 172 of trigger 92, sear coil spring 180 has rotated sear 140 counter clockwise relative to trigger 92, and protrusion 168 of sear 140 is now again in contact with underside of slider 150 to the left of third contact surface 170.

Figure 3:
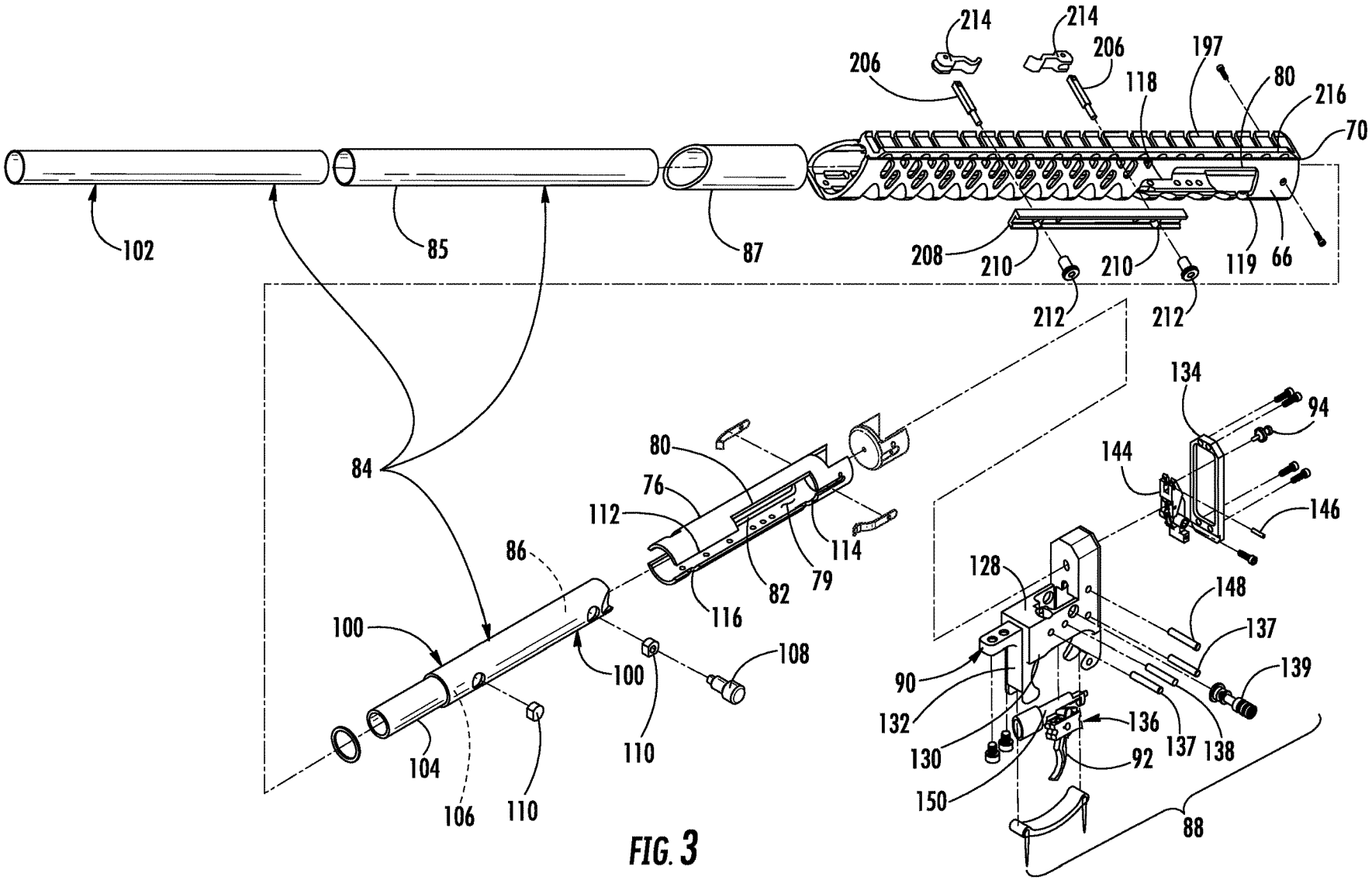
FIG. 3 is an exploded isometric view of components of the shotgun of FIG. 1.
Figure 19:
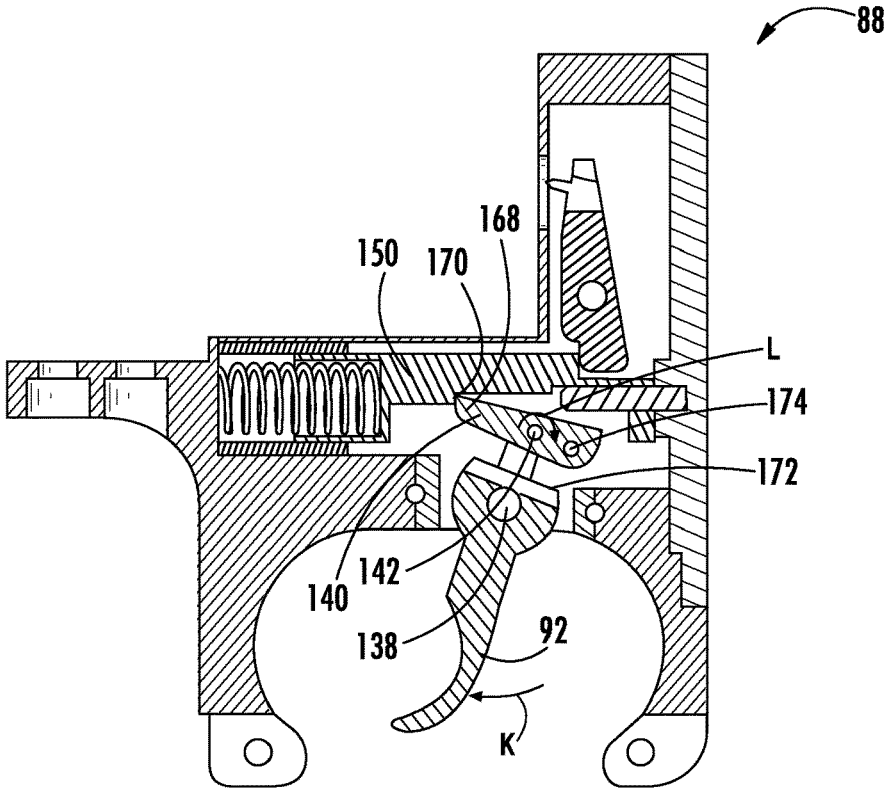
FIG. 19 is a cross-sectional schematic view as in FIG. 18, with the trigger moved back fully to the unactuated position and the seer reengaging the slider.
Figure 20:
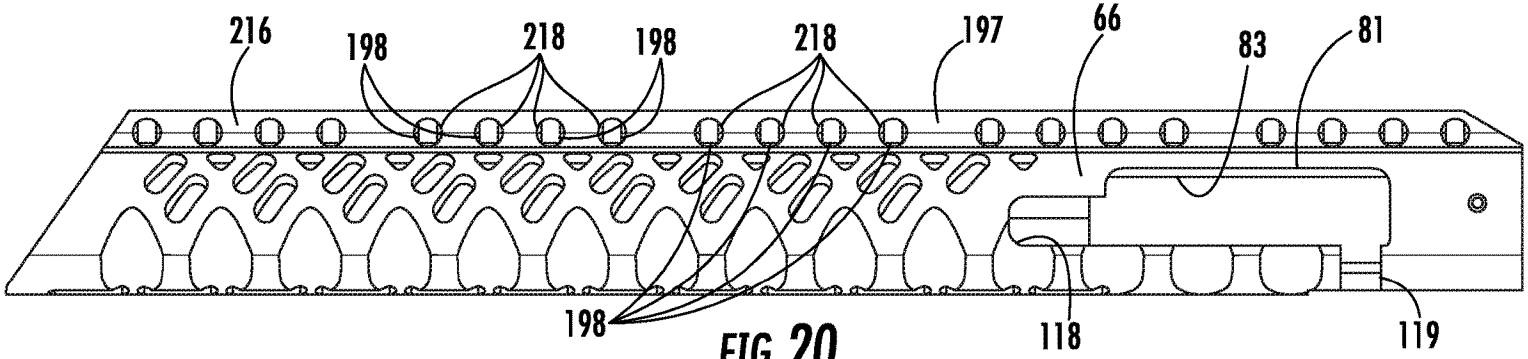
FIG. 20 is a side view of a handguard of the shotgun.
Figure 21:
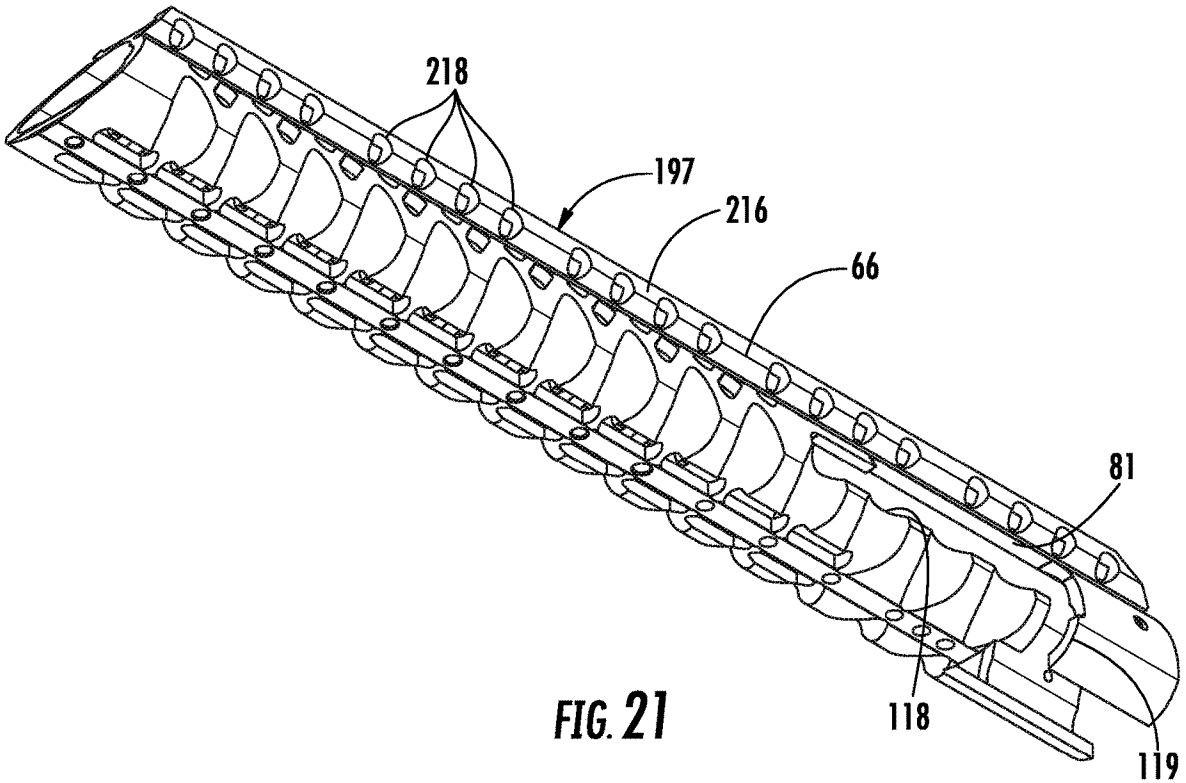
FIG. 21 is a bottom isometric view of the handguard.
Figure 22:
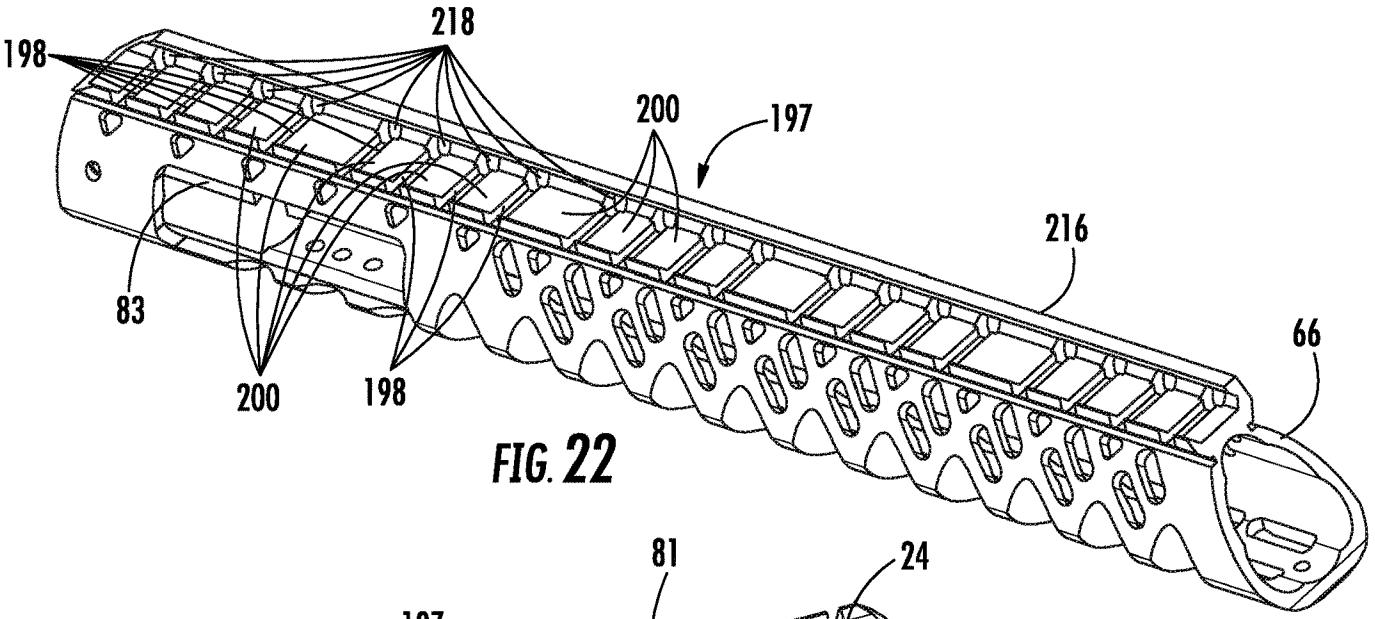
FIG. 22 is a top right-side isometric view of the handguard.

In FIG. 19, the user has fully released trigger 92. As trigger 92 and sear 140 return further toward the unactuated position of FIG. 10 (arrow K), protrusion 168 slides along the underside of slider 150 until protrusion 168 passes third contact surface 170, at which point sear coil spring 180 rotates sear 140 clockwise relative to trigger 92 (arrow L), thereby placing protrusion 168 back in contact with third contact surface 160 of slider 150. Only at this point, can trigger 92 be pulled again to fire another shell. If trigger 92 is pulled before sear protrusion 168 reengages slider fourth contact surface 172, slider 150 will not be moved and accordingly hammer 144 and firing pin 94 will not be moved. A conventional trigger safety pin 139 (see FIG. 3) may be provided in housing 90 to prevent inadvertent movement of trigger 92 from the rest position to the actuated position.

Arrangements and/or dimensioning of certain of the above elements assist with providing a compact trigger assembly 88 and a compact shotgun 40 that can be suitable for underbarrel mounting. For example, if trigger 92, when in the actuated (pulled) position, extends toward back 134 of housing 90 further than hammer axle 148, front-rear compactness is improved. In other words, hammer 144 and hammer compartment 145 do not extend appreciably rearward of trigger 92 in trigger assembly 88. Also, if a trigger guard 188 of trigger assembly 88 is arranged so that hammer axle 148 is located between back edge 190 of trigger guard 188 and trigger axle 138, front-rear compactness is improved. In other words, hammer axle 144 and hammer compartment 145 does not extend appreciably rearward of trigger guard 188, and back edge 190 of trigger guard 188 may extend about the same distance rearward as back 134 of housing 90.

Also, a relatively small hammer compartment 145 can assist in rendering trigger assembly 88 more compact. Thus, hammer compartment 145 may for example have a length from front to rear of less than about 1.0 inches, and/or such length may be smaller than a distance between back 134 of housing 90 and trigger axle 138. In other words, hammer compartment 145 may be small enough to be rearward of trigger axle 138.

Connecting structure on shot gun 40 for connecting the shot gun to accessory mounting rail 54 may be in some embodiments a conventional rail/adapter connector assembly, such as a Picatinny rail design or other connector design, allowing removable connection between shotgun 40 and long gun 42. However, use of connecting structure 72 described herein may also be used. Connecting structure 72 may allow for a more efficient attachment of shot gun 40 to certain long guns 42 by providing more precise adjustability of alignment between the guns being joined. Moreover, connecting structure 72 provides independent utility as a connector with a conventional rail such as mounting rail 54 or other.

Figure 30:
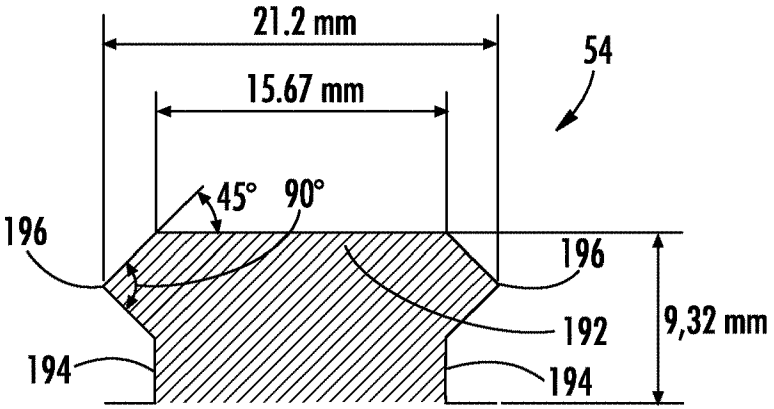
FIG. 30 is a sectional view through one of the ridges of the Picatinny rail of FIG. 29 showing a part of an adapter portion of the handguard as would be attached to the Picatinny rail.
Figure 29:
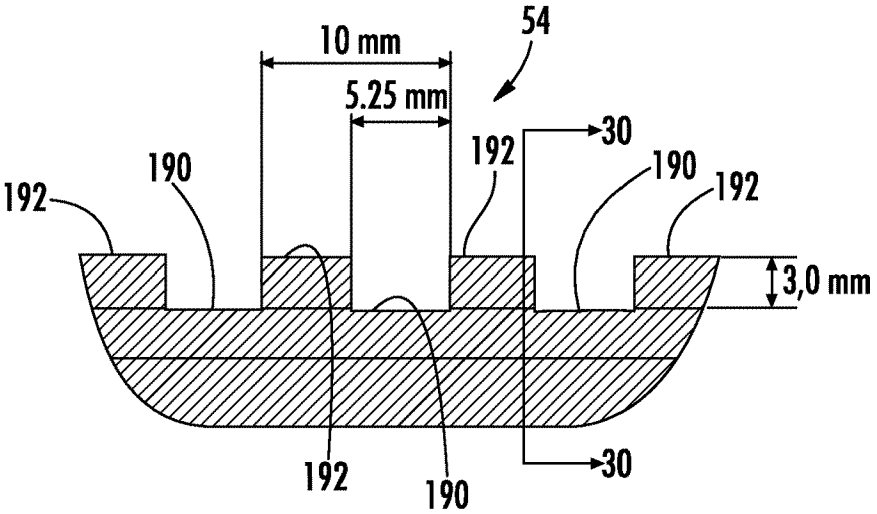
FIG. 29 is a side view of a portion of a Picatinny rail.

As illustrated in detail in FIGS. 29-30, rail 54 is a grooved rail defining first grooves 190 separated by first ridges 192 in a repeating pattern, a width of each first groove 190 being substantially identical, a width of each first ridge 192 being substantially identical so that a first pitch of the first grooves 190 is substantially equal along the grooved rail 54. Grooves 190 are about 5.25 mm while ridges 192 are about 4.75 mm, for a repeating pattern (pitch) at about each 10.00 mm (pitch unit length). FIG. 30 shows a Picatinny rail ridge 192 cross-section in which ridge has two undercut portions 194 forming extensions 196 suitable for gripping by another member. Extensions are angled at 45 degrees above and below for a 90 degree span, but other shapes are possible. Accordingly, the disclosure is not limited to use with Picatinny rails, but includes any rail with repeating grooves and ridges according to the present disclosure.

Connecting structure 72 includes a rail member 197 defining second grooves 198 separated by second ridges 200 in a repeating pattern, a width of each second groove 198 being substantially identical and substantially identical to the width of first grooves 190 (e.g., 5.25 mm). A second pitch of at least some of the second grooves 198 is different than the first pitch so that a ratio of a pitch unit length of the second pitch to a pitch unit length of the first pitch is a non-whole integer ratio. Spacing first and second grooves 190,198 differently (with longer ridge 200 distances) allows rail member 197 of shotgun 40 to be connectable to grooved rail 54 of long gun 42 in multiple relative orientations by alignment of at least one of the first grooves 190 with at least one of the second grooves 198 to form at least one passageway 202. The multiple relative orientations are separated from each other by a distance smaller than the first pitch (about 10.00 mm, i.e., the Picatinny rail pitch). Such adjustability allows shotgun 40 to be attached to long gun 42 at a rearwardly optimized orientation more precisely than would be possible if rail member 197 were a second Picatinny rail spaced member. Such adjustability will be discussed in detail below.

A connector 204 includes at least one rod 206 insertable through passageway 202 for securing the rail member to the grooved rail thereby connecting shotgun to the long gun. As shown, two rods 206 are provided extending through a housing 208 via openings 210. Rods 206 may be releasably tightenable by various structures, such as nuts 212 on one end and over center clamps 214 on the other. Alternately, threaded screws, clips or other connectors could be employed.

Rail member 197 on body member 66 includes a hook 216 extending axially along one side for capturing extensions 196 of ridges 192. Openings 218 through hook 216 are located adjacent grooves 198 and are sized to receive rods 206/nuts 212 therethrough. Hook 216 includes a flat surface 220 for seating housing 208 therealong (see FIG. 24).

To attach rail members 54,197 together, they are positioned so that certain of the grooves 190,198 align to form passageways 202, then rods 206 are slid through the passageways, threaded into nuts 212 until finger tight, at which point over center clamps 214 are tightened so secure the rail members together. Although a modified Picatinny rail structure is shown herein should be understood other structures and connecting elements are possible. Also, fewer or more than one rod/nut/clamp 206/212/214 could be used, or more than one assembly including a housing 208 with associated rod/nut/claim structure.

It should also be understood that the benefits described herein with reference to connecting structure 72 and spacing of grooves of rail member 197 have broad applicability outside of gun connection and/or use with exiting connectors, such as Picatinny rail connecting systems or others, or other custom rail systems. Thus, the present disclosure provides an adapter and a connector system beyond the described exemplary use with gun mounts.

FIGS. 31-35 show sectional views through rails members 54 and 197 showing relative adjustment possibilities with certain pitch spacing used on rail 197. Rods 206 and associated fastening structures are eliminated for clarity. As shown, grooves 190(*a*)-190(*o*) are alignable in various orientations with grooves 198(*a*)-198(*h*). Fewer or more repeats of both groove series are possible.

Passageways 202(*a*)-202(*j*) are created in pairs in the sequential orientations. Staring with FIG. 31, each successive view shows rail 197 moved ¼ of the pitch of rail 54 rightward relative to rail 54. So, if the rail 54 groove/ridge pitch is about 10.00 mm as noted above, the movement is about 2.50 mm per view. Note that the width of ridges 192 between grooves 198(*a*) to 198(*d*) is identical, but the width of the ridge between grooves 198(*d*) and 198(*e*) is slightly larger, which is an optional modification to allow for a further spacing between 202(*a*) and 202(*b*).

Figure 31:
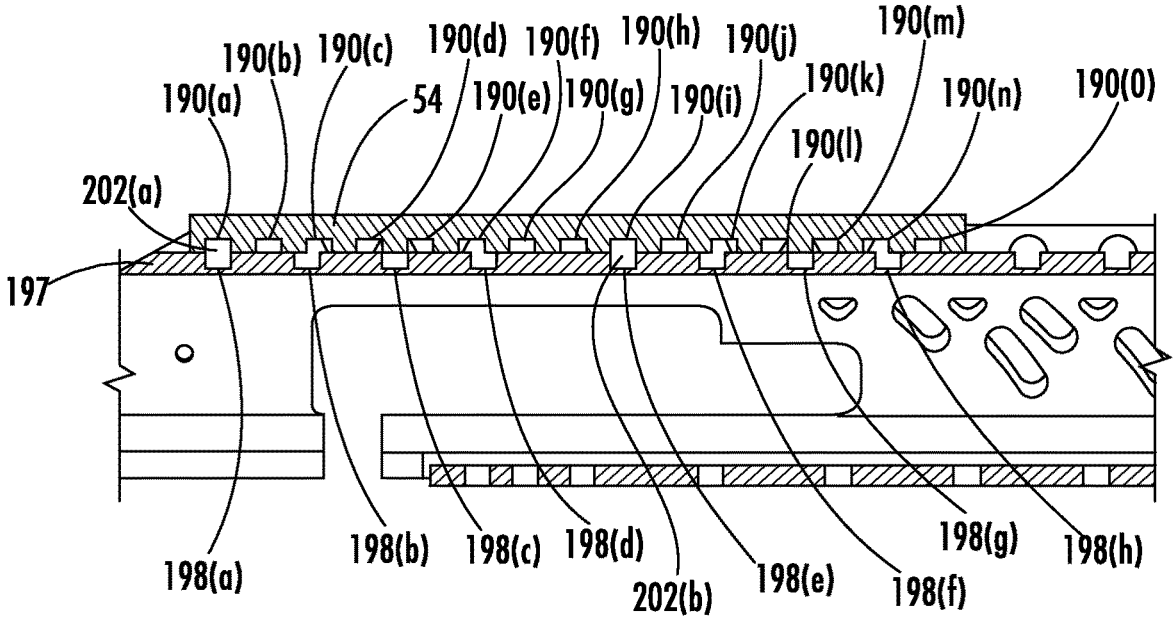
FIG. 31 is a partial sectional view showing the Picatinny rail and adapter on the handguard in a first mounting position.

In FIG. 31, passageway 202(*a*) is formed by grooves 190(*a*) and 198(*a*) and passageway 202(*b*) is formed by grooves 190(*i*) and 198(*e*). Note that had the pitch of grooves 198/ridges 200 been consistent all along rail 197, then passageway would be between 190(*h*) and 198(*d*). Either orientation is acceptable, but the illustrated design with uneven total pitch allows for a lengthier connection between passages 202(*a*) and 202(*b*), and thus a more stable connection between rails 54 and 197.

Figure 32:
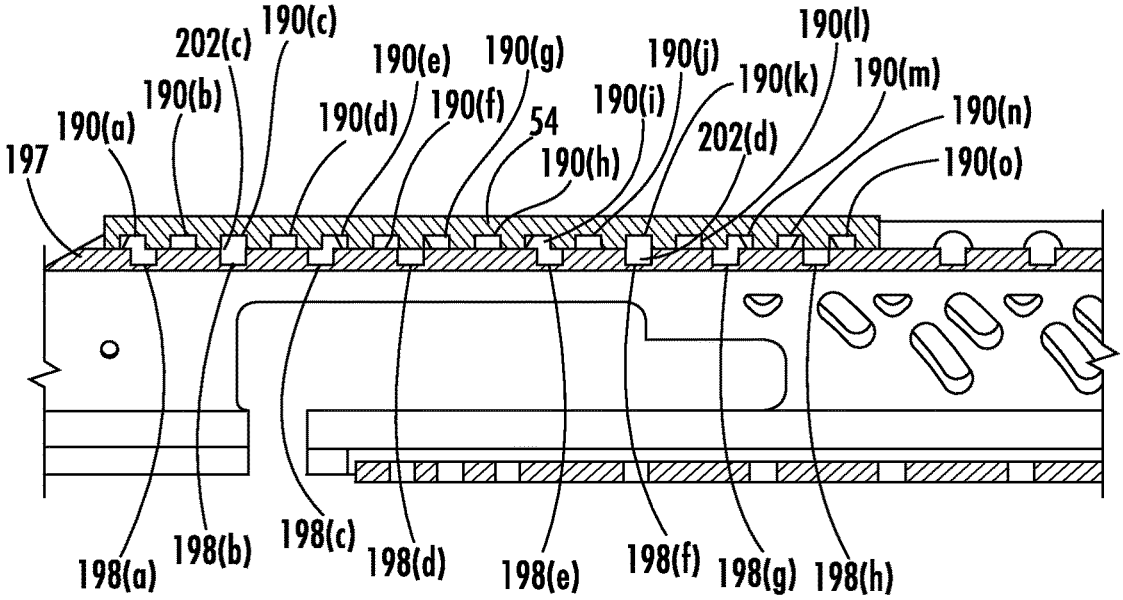
FIG. 32 is a partial sectional view as in FIG. 31 showing the Picatinny rail and adapter on the handguard in a second mounting position one-fourth of a Picatinny rail pitch unit away from the first mounting positon.

In FIG. 32, the rails 54/197 are slid relatively ¼ the pitch of grooves 190/ridges 192 (e.g., about 2.5 mm), and passageway 202(*c*) is formed by grooves 190(*c*) and 198(*b*) and passageway 202(*d*) is formed by grooves 190(*k*) and 198(*f*).

Figure 33:
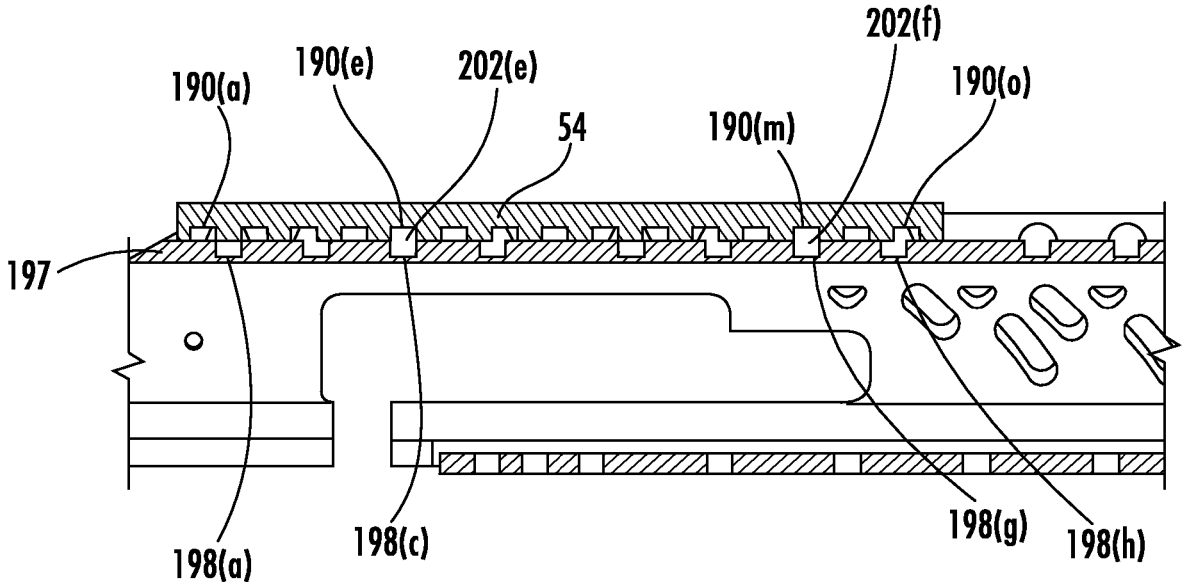
FIG. 33 is a partial sectional view as in FIG. 31 showing the Picatinny rail and adapter on the handguard in a third mounting position two-fourths of a Picatinny rail pitch unit away from the first mounting positon.

In FIG. 33, the rails 54/197 are slid further relatively ¼ the pitch of grooves 190/ridges 192 (e.g., about 2.5 mm), and passageway 202(*e*) is formed by grooves 190(*e*) and 198(*c*) and passageway 202(*f*) is formed by grooves 190(*m*) and 198(*g*).

Figure 34:
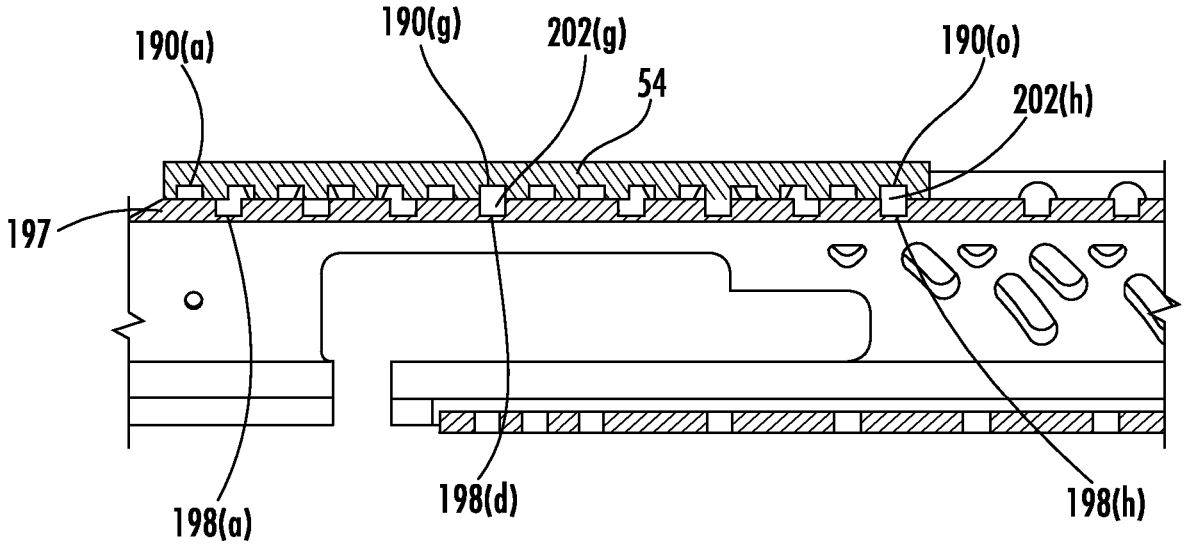
FIG. 34 is a partial sectional view as in FIG. 31 showing the Picatinny rail and adapter on the handguard in a fourth mounting position three-fourths of a Picatinny rail pitch unit away from the first mounting positon.

In FIG. 34, the rails 54/197 are slid further relatively ¼ the pitch of grooves 190/ridges 192 (e.g., about 2.5 mm), and passageway 202(*g*) is formed by grooves 190(*g*) and 198(*d*) and passageway 202(*h*) is formed by grooves 190(*o*) and 198(*h*).

Figure 35:
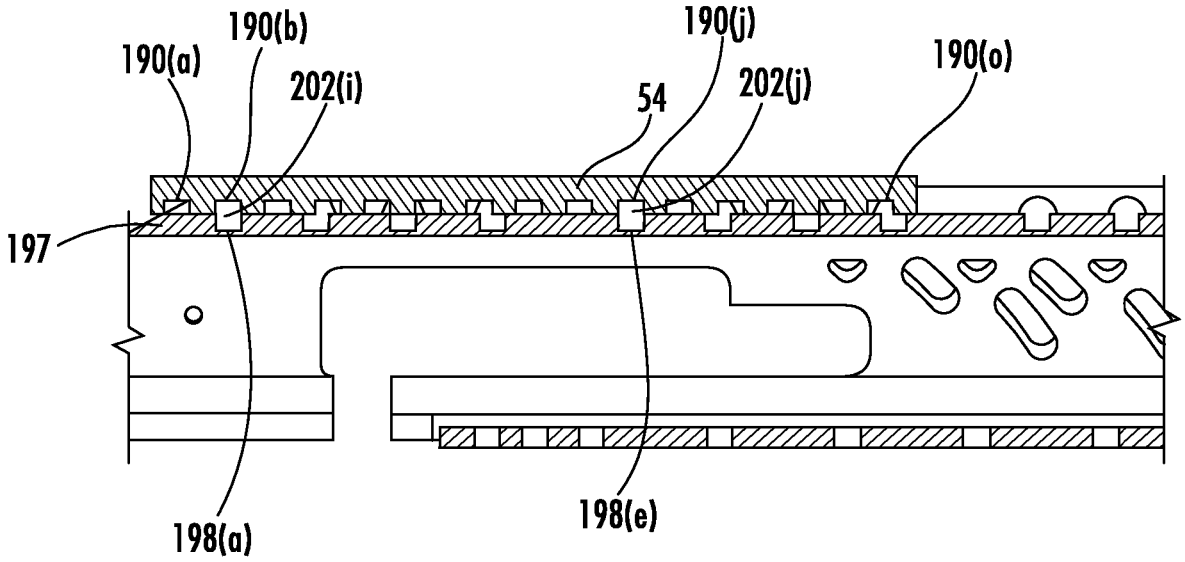
FIG. 35 is a partial sectional view as in FIG. 31 showing the Picatinny rail and adapter on the handguard in a fifth mounting position one full Picatinny rail pitch unit away from the first mounting positon.

In FIG. 35, the rails 54/197 are slid further relatively ¼ the pitch of grooves 190/ridges 192 (e.g., about 2.5 mm), and passageway 202(*i*) is formed by grooves 190(*b*) and 198(*a*) and passageway 202(*j*) is formed by grooves 190 (*j*and 198(*e*). Had the pitch of grooves 198/ridges 200 of rail 197 been the same as in rail 54, the axial orientation of FIG. 35 (where first groove 198(*a*) aligns with the second groove 190(*b*)) would be the finest adjustment possible between rails 54 and 197. However, with the pitch used herein, most ridges 200 are about 12.25 mm, giving a pitch of 17.5 mm for each groove 198/ridge 200 pair. Thus, matching passageways 202 are formed in a repeating pattern of four groove 198/ridge 200 pairs and seven groove 190/ridge 190 pairs. (17.5×4=70 mm and 10 mm×7=70 mm). By having different pitches that are whole integer fractions of one another, adjustability is provided in an amount smaller than that of the pitch of the smaller pitched rail, according to the smaller integer number. In other words, if as shown the smaller pitched rail has a pitch of 10 mm, and the ratio of repeats is 4/7, then the finer adjustability between the rails is ¼ of 10.0 mm (e.g. 2.5 mm). If the ratio of repeats were 3/5, then the finer adjustability between the rails would be ⅓ of 10 mm (e.g. 3.3 mm). If the ratio of repeats were 2/1, then the finer adjustability would be ½ of 10 mm (e.g. 5.0 mm). If the larger number determines how far apart the repeat appear. So, if the ratio were for example 4/9 instead of 4/7, then the created passages would be spaced further apart, which may or may not be desirable in some applications. The 4/7 ratio (with the differing spacing on one set of ridges 200) produced a reliable spacing suitable for conveniently under-mounting shotgun 40 to a Picatinny rail. However, for this application or other applications, it should be understood that the disclosed adapter and rail system can be applied in multiple different ways with different ratios. For larger items, and/or for more precise adjustability, higher numbers could be used in the ratio (e.g. 15/19).

Accordingly, a compact shotgun, a trigger assembly that could be used with such compact shotgun or other firearms, and an adapter and multipurpose mount that could be used with firearms or other devices are all disclosed above, and include the exemplary embodiments shown and variations explained as possible and permissible at law. While preferred embodiments of the invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

I claim:

1. A shotgun for firing a shell and mountable beneath a long gun, the shotgun comprising:

a body member having a front end, a rear end, and a connecting structure located along a top side of the body member for attaching the body member to the long gun, the body member being mountable to a connecting structure on a bottom side of a barrel of the long gun by the connecting structure on the body member of the shotgun;

a breech tube fixedly located within the body member proximate the rear end, the breech tube having at least one lateral opening though which a shell may be moved;

a barrel mounted so as to be axially slidable within the body member and the breech tube, the barrel including a chamber portion and a forward portion attached to the chamber portion, the chamber portion including a chamber, a first barrel section, and a forcing cone between the chamber and the first barrel section, the barrel movable between a rearward position wherein a shell in the breech tube is within a chamber of the barrel and a forward position wherein a shell is loadable or unloadable from the breech tube via the at least one lateral opening; and a trigger assembly including a housing mounted to the body member proximate the rear end, the housing supporting a trigger, a firing pin, and a firing mechanism operatively interconnecting the trigger and the firing pin for actuating the firing pin when the trigger is pulled.

2. The shotgun of claim 1, wherein the barrel has a length of at least 18 inches.

3. The shotgun of claim 1, wherein the chamber portion has an axial length of about 9.5 inches.

4. The shotgun of claim 1, wherein an axial length measured between a front end of the barrel and a rear end of the trigger assembly is less than about 19.0 inches.

5. The shotgun of claim 4, wherein the rear end of the trigger assembly extends rearwardly past a rear end of the barrel less than about 1.0 inches.

6. The shotgun of claim 1, wherein the trigger assembly is located just forward of a magazine of the long gun.

7. The shotgun of claim 1, wherein the firing mechanism includes a hammer for actuating the firing pin when moved by a spring-loaded slider.

8. The shotgun of claim 7, wherein the firing mechanism includes a spring-loaded sear mounted on the trigger for contacting the spring-loaded slider.

9. The shotgun of claim 8, wherein the trigger assembly includes a sub-housing removably attached to the housing, the trigger and spring-loaded sear being mounted on the sub-housing.

10. The shotgun of claim 7, wherein the hammer is spring-loaded in a direction to move the firing pin away from the firing position and to move the hammer toward contact with the spring-loaded slider.

11. The shotgun of claim 1, wherein the trigger assembly is a double-action trigger assembly.

12. The shotgun of claim 1, wherein the at least one lateral opening in the breech tube includes two lateral openings spaced on opposite sides of the breech tube.

13. The shotgun of claim 12, further including at least one extractor attached to the breech tube for moving a shell located in the chamber at least partially out of the breech tube when the barrel is moved from the rearward position to the forward position.

14. A shotgun for firing a shell and mountable beneath a long gun, the shotgun comprising:

a body member having a front end, a rear end, and a connecting structure located along a top side of the body member for attaching the body member to the long gun;

a breech tube fixedly located within the body member proximate the rear end, the breech tube having at least one lateral opening though which a shell may be moved;

a barrel mounted so as to be axially slidable within the body member and the breech tube, the barrel movable between a rearward position wherein a shell in the breech tube is within a chamber of the barrel and a forward position wherein a shell is loadable or unloadable from the breech tube via the at least one lateral opening; and a trigger assembly including a housing mounted to the body member proximate the rear end, the housing supporting a trigger, a firing pin, and a firing mechanism operatively interconnecting the trigger and the firing pin for actuating the firing pin when the trigger is pulled;

the connecting structure being configured for attachment to a grooved rail defining first grooves separated by first ridges in a repeating pattern, a width of each first groove being substantially identical, a width of each first ridge being substantially identical so that a first pitch of the first grooves is substantially equal along the grooved rail;

the connecting structure including a rail member defining second grooves separated by second ridges in a repeating pattern, a width of each second groove being substantially identical and substantially identical to the width of the first grooves, a second pitch of at least some of the second grooves being different than the first pitch so that a ratio of a pitch unit length of the second pitch to a pitch unit length of the first pitch is a non-whole integer ratio whereby the rail member of the shotgun is connectable to the grooved rail of the long gun in multiple relative orientations by alignment of at least one of the first grooves with at least one of the second grooves to form at least one passageway, the multiple relative orientations being separated from each other by a distance smaller than the first pitch, thereby allowing the shotgun to be attached to the long gun at a rearwardly optimized orientation; and a connector insertable through the passageway for securing the rail member to the grooved rail thereby connecting shotgun to the long gun.

15. The shotgun of claim 14, wherein the ratio includes more of the first grooves and the first ridges than of the second grooves and second ridges.

16. The shotgun of claim 14, wherein the distance by which the multiple orientations are separated from each is no more than about one-half of the first pitch.

17. The shotgun of claim 16, wherein the distance by which the multiple orientations are separated from each is about one-third of the first pitch.

18. The shotgun of claim 16, wherein the distance by which the multiple orientations are separated from each is about one-fourth of the first pitch.

19. The shotgun of claim 14, wherein the ratio of the pitch unit length of the second pitch to the pitch unit length of the first pitch is 4:7.

20. The shotgun of claim 14, wherein the ratio of the pitch unit length of the second pitch to the pitch unit length of the first pitch is 3:5.

21. The shotgun of claim 14, wherein the grooved rail is a Picatinny rail.

22. The shotgun of claim 14, including at least two of the connectors, each connector being insertable through a respective passageway.

* * * * *